US008845410B2

(12) United States Patent
Ikeya et al.

(10) Patent No.: US 8,845,410 B2
(45) Date of Patent: Sep. 30, 2014

(54) MULTI-STATION GAME MACHINE

(75) Inventors: Tomonobu Ikeya, Kanagawa (JP); Keiri Yoshioka, Kanagawa (JP)

(73) Assignee: Konami Gaming, Inc., Las Vegas, NV (US)

( * ) Notice: Subject to any disclaimer, the term of this patent is extended or adjusted under 35 U.S.C. 154(b) by 221 days.

(21) Appl. No.: 13/486,595

(22) Filed: Jun. 1, 2012
(Under 37 CFR 1.47)

(65) Prior Publication Data

US 2012/0302315 A1 Nov. 29, 2012

Related U.S. Application Data

(63) Continuation of application No. 12/284,228, filed on Sep. 19, 2008, now Pat. No. 8,216,046, which is a continuation-in-part of application No. 10/356,633, filed on Feb. 3, 2003, now Pat. No. 7,465,226.

(30) Foreign Application Priority Data

Feb. 1, 2002 (JP) ..... 2002-025699

(51) Int. Cl.
*G07F 17/32* (2006.01)

(52) U.S. Cl.
USPC ..... 463/17; 463/16; 463/25

(58) Field of Classification Search
USPC ..... 463/17, 20, 25
IPC ..... G07F 17/32
See application file for complete search history.

(56) References Cited

U.S. PATENT DOCUMENTS

| | | | | |
|---|---|---|---|---|
| 5,116,055 | A | | 5/1992 | Tracy |
| 5,775,993 | A | * | 7/1998 | Fentz et al. ..... 463/17 |
| 5,827,119 | A | | 10/1998 | Bromley |
| 5,857,910 | A | | 1/1999 | Watanabe et al. |
| 5,879,235 | A | | 3/1999 | Kaneko et al. |
| 6,059,659 | A | * | 5/2000 | Busch et al. ..... 463/17 |
| 6,093,101 | A | | 7/2000 | Mourad |
| 6,287,195 | B1 | | 9/2001 | Sugimoto et al. |
| 6,302,791 | B1 | | 10/2001 | Frohm et al. |
| 6,364,314 | B1 | | 4/2002 | Canterbury |
| 6,413,162 | B1 | | 7/2002 | Baerlocher et al. |
| 6,446,965 | B1 | | 9/2002 | Boulton |
| 6,733,390 | B2 | | 5/2004 | Walker et al. |
| 6,938,900 | B2 | | 9/2005 | Snow |
| 2001/0036857 | A1 | | 11/2001 | Mothwurf et al. |
| 2002/0183105 | A1 | | 12/2002 | Cannon et al. |
| 2003/0064773 | A1 | | 4/2003 | Baerlocher et al. |

FOREIGN PATENT DOCUMENTS

| | | |
|---|---|---|
| JP | 06-238033 | 8/1994 |

* cited by examiner

*Primary Examiner* — Omkar Deodhar
(74) *Attorney, Agent, or Firm* — Howard & Howard Attorneys PLLC

(57) ABSTRACT

A multi-station game machine, including at least two stations that are configured to accept player inputs, a wheel having a plurality of sections including symbols, the wheel being configured to rotate, the wheel being disposed so that a front surface of the wheel can be seen from at least two players, and a controller for controlling a first game performed by the wheel and a second game performed on the stations, wherein the wheel is configured to enable at least two players to simultaneously play the first game respectively using the stations, wherein the stations are configured such that the players bet a game value on the symbols via a bet area displayed on a display provided on each of the stations, and wherein the controller triggers the second game based on a win of the first game.

20 Claims, 18 Drawing Sheets

SHARED PAYOUT LINE: ht14, ht15, ht16, ht17, ht18, ht19

MULTI-STATION GAME MACHINE

This application is a continuation of U.S. patent application Ser. No. 12/284,228, filed on Sep. 19, 2008, now U.S. Pat. No. 8,216,046, which issued on Jul. 10, 2012, which is a continuation-in-part application of U.S. patent application Ser. No. 10/356,633 filed on Feb. 3, 2003 now U.S. Pat. No. 7,465,226, which claims priority to Japanese Patent Application No. P 2002-025699 filed on Feb. 1, 2002.

BACKGROUND OF THE INVENTION

The present invention relates to a multi-station game machine which allows a plurality of players to play games together and in which symbols are moved horizontally.

A game machine 100 shown in FIG. 11 is a game machine in which one player plays a game. At the time of playing a game, a player initially inserts a plurality of tokens to be used for betting purpose, via a token insert slot 101.

The player presses any one of credit bet buttons 102*a*, 102*b*, and 102*c*, to thereby bet tokens on a desired one of payout lines p1, p2, p3, p4, and p5 along which symbols would constitute a certain winning combination.

Then, the player presses a start lever 103, to thereby start spinning symbol reels 111, 112, and 113, each having a predetermined number of symbols 121*e* . . . , 122*e* . . . , and 123*e* . . . drawn on peripheral faces thereof.

After having continued spinning for a while, the symbol reels 111, 112, and 113 are automatically, sequentially stopped.

If, after the reels are stopped, a winning combination is constituted by a symbol on the symbol reel 111, a symbol on the symbol reel 112, and a symbol on the symbol reel 113 that are aligned along a payout line on which the player bets tokens beforehand, a certain number of tokens assigned to the symbols are paid to the player via a token payout hole 104.

As mentioned above, the game machine 100 is a game machine on which a single player plays games, but fails to allows a plurality of players to play games simultaneously.

SUMMARY OF THE INVENTION

It is therefore an object of the present invention to provide a multi-station game machine, which allows a plurality of players to enjoy playing games.

In order to achieve the above object, according to the present invention, there is provided a multi-station game machine, including at least two stations that are configured to accept player inputs, a wheel having a plurality of sections including symbols, the wheel being configured to rotate, the wheel being disposed so that a front surface of the wheel can be seen from at least two players, and a controller for controlling a first game performed by the wheel and a second game performed on the stations, wherein the wheel is configured to allow at least two players to simultaneously play the first game respectively using the stations, wherein the stations are configured such that the players bet a game value on the symbols via a bet area displayed on a display provided on each of the stations, and wherein the controller triggers the second game based on a win of the first game.

In the above configuration, a plurality of players can enjoy playing games simultaneously and the player who won the first game performed on the wheel can obtain the second game based on this win.

According to the present invention, there is also provided a multi-station game machine, including, at least two stations that are configured to accept player inputs, a first display for displaying a wheel having a plurality of sections including symbols, the wheel being arranged to rotate, the first display being arranged so that a front surface of the first display can be seen from the players, and a controller for controlling a first game performed on the first display and a second game performed on the stations, wherein the plurality of sections is displayed on the first display to enable at least two players to simultaneously play the first game respectively using the stations, wherein the stations are configured such that the players bet a game value on the symbols via a bet area displayed on a display provided on each of the stations, and wherein the controller triggers the second game based on a win of the first game.

In the above configuration, a plurality of players can enjoy playing games simultaneously using the wheel displayed on the display.

Preferably, the multi-station game machine, further including, a shared button for specifying the station that a player shares a bet area with, and a payout unit for paying reward when a win is established, wherein the payout unit is configured such that when at least one of the players bets a game value on the shared bet area, at least one player does not bet any game value on the shared bet area, and a win is established on the shared bet area, the payout unit pays a first payment to the players that bet on the shared bet area as a reward for establishment of the win, and also pays a second payment to the at least one player who specified the station to share the bet area by the shared button but did not bet on the shared bet area.

In the above configurations, a shared button for specifying a shared bet area with players is provided on the station. Hence, use of the shared button allows players on the multi-station game machine to share the pleasure stemming from achievement of a win.

Preferably, the multi-station game machine, further including, a plurality of speakers, each speaker being disposed on the station, and a speaker controller, which controls emission of sound from the speakers, wherein the speaker controller emits game sound from the speaker on a station when a symbol rotating around a circumference of the wheel aligns with a symbol of the wheel onto which a game value has been betted from the station.

In the above configuration, speakers provided around the station emit sound or become muted, thereby enabling attractive presentation of games.

Preferably, the multi-station game machine, further including a plurality of lamps, each lamp being disposed around the wheel; and a lamp controller, which controls illumination and extinction of the plurality of lamps when a mark rotating around relative to the wheel aligns a symbol on the wheel onto which a game value has been betted from the station.

In the above configuration, lamps disposed around the wheel are illuminated and extinguished, thereby enabling attractive presentation of games.

Another aspect of the present invention is a multi-station game machine, including at least two stations that are configured to accept player inputs, each of the stations including a card reader for reading data recorded on the card, and a center unit for gathering the data, performing a lottery operation for selecting a player among players on the stations, the center unit is being connected to the stations via network, wherein the center unit performs the lottery using the data at a predetermined time and triggers a second game on an stations of the selected player.

In the above configurations, a lottery game performed in a central unit trigger the second game performed on the stations. Hence, unexpected amusement can be provided to players on the multi-station game machine.

In the above configuration, the lottery operation includes a function for determining a reward amount of the second game based on a progressive amount accumulated by the lottery operations.

In the above configurations, the second game is displayed on a second display provided on each of the station or on a first display, which is independent from the stations.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

First Embodiment

An embodiment of a game machine according to the invention will be described hereinafter by reference to the drawings.

Figure 1:
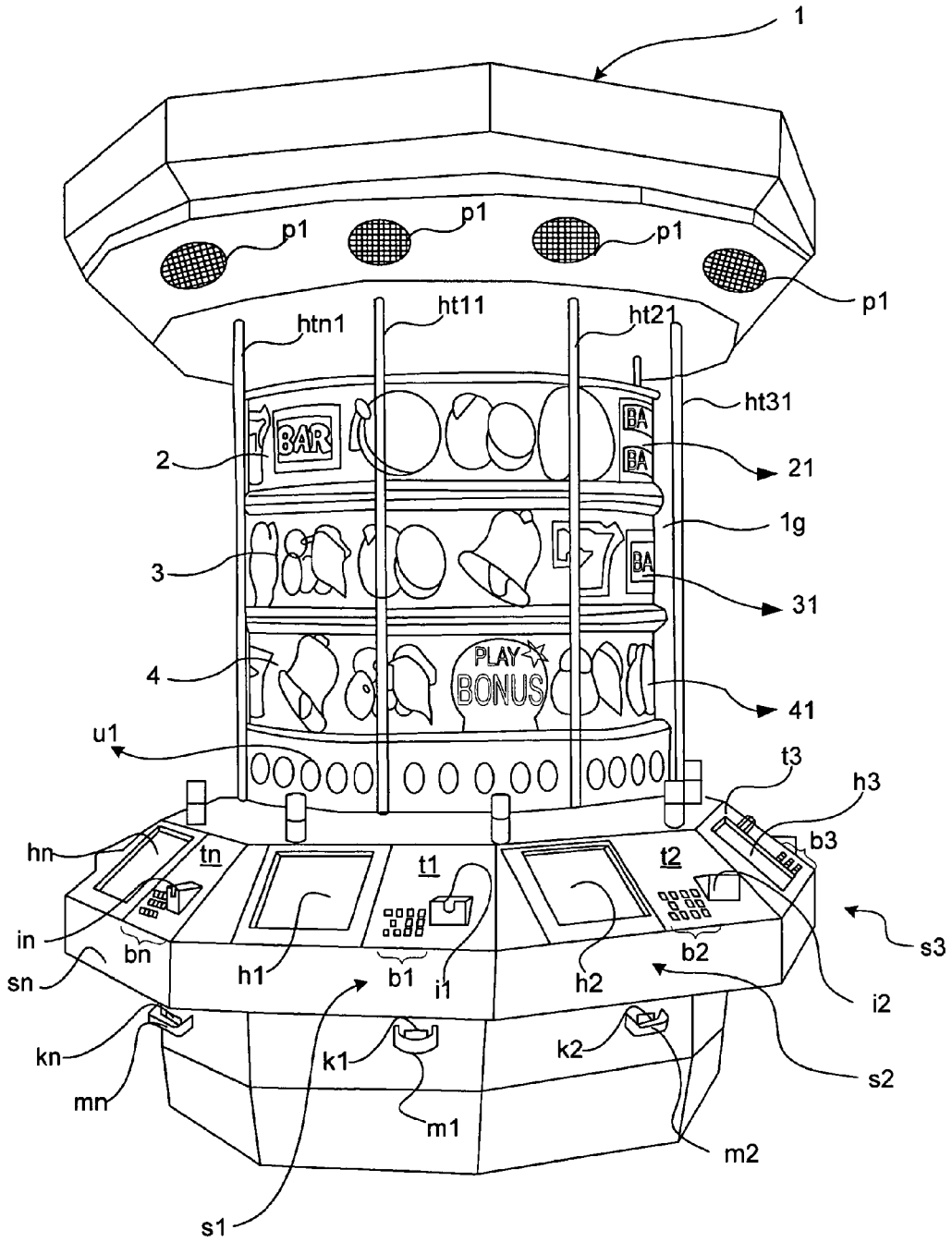
FIG. 1 is a perspective view showing a multi-station game machine according to an embodiment of the invention.
Figure 2:
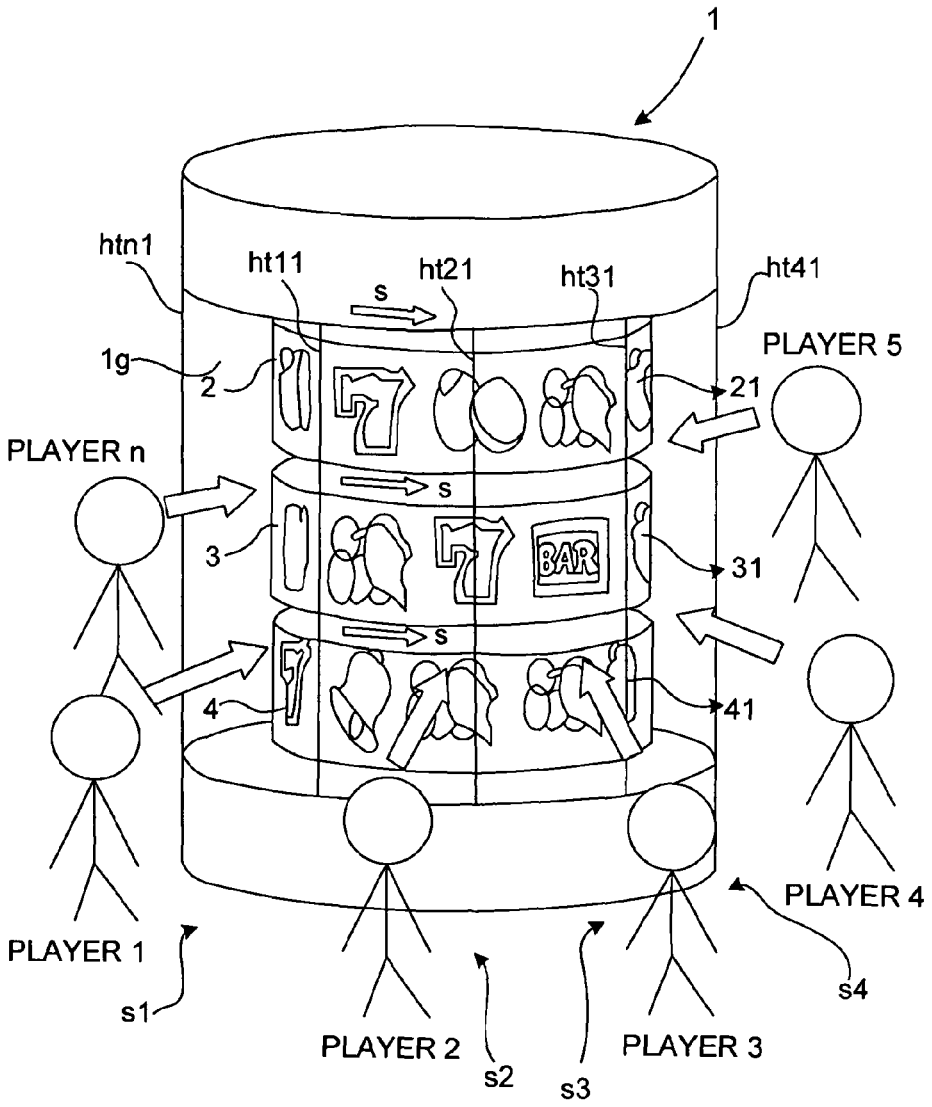
FIG. 2 is a conceptual perspective view showing a playing status of the multi-station game machine of the embodiment.

As shown in FIG. 1, and in FIG. 2, which is a conceptual rendering, a multi-station game machine 1 is a game machine on which a plurality of players enjoy playing combination games (first games), by using any of stations s1, s2, s3, s4, . . . sn.

At the time of a combination game, symbol reels 2, 3, and 4 spin horizontally (in the direction "s" of arrow shown in FIG. 2) around a vertical shaft in a concentric manner while displaying a plurality of symbols 21 . . . , a plurality of symbols 31 . . . , and a plurality of symbols 41 . . . on respective peripheral faces of the symbol reels. While the symbol reels 2, 3, and 4 are spinning, the players select desired payout lines from payout lines ht11, ht12, ht13 . . . (see FIG. 6, which will be described later) provided at the stations (any of s1, s2, . . . sn) occupied by the players, and bet previously-inserted game values, (e.g., tokens, coins, paper currency, or some form of credit indicator, such as a credit card) on the thus-selected payout lines.

After the players bet coins or tokens on the payout lines, the symbol reels 2, 3, and 4 are sequentially stopped. Symbols that would constitute a certain winning combination are aligned with the respective payout lines ht11, ht12, ht13 . . . . When the payout lines ht11, ht12, ht13, . . . along which the symbols are successfully aligned coincide with the payout lines on which the players bet coins or tokens, a predetermined number of coins or tokens assigned to the symbols that constitute a predetermined winning combination are paid to the players who are awarded wins.

As shown in FIG. 1, in the multi-station game machine 1, the symbol reel 2, on whose peripheral face symbols 21, 22, 23 . . . are displayed; the symbol reel 3, on whose peripheral face symbols 31, 32, 33, . . . are displayed; and the symbol reel 4, on whose peripheral face symbols 41, 42, 43, . . . are displayed are supported in a concentric manner so as to be rotatable around the vertical center. The multi-station game machine 1 is installed upright such that a protective glass 1g for protecting the outside of peripheral faces of the symbol reels 2, 3, and 4 assumes a cylindrical shape.

A predetermined number of speakers (game speakers) p1 for emitting sound effects for games are disposed in positions elevated from the symbol reels 2, 3, and 4. Further, a predetermined number of game lamps u1 . . . for emitting illumination effects for game are provided in positions lower than the symbol reels 2, 3, and 4 so as to surround an exterior circumferential wall face.

The outer peripheral section of the multi-station game machine 1 is divided into stations s1, s2, s4, s4 . . . sn, all having identical configurations, to be used by players at the time of playing games. Reference payout lines ht11, ht21, . . . htn1 (which will be described later), which are payout lines of one type, are arranged at positions on the protective glass 1*g* so as to correspond to the center positions of respective stations.

Here, the reference payout lines ht11, ht21, . . . htn1 are provided as colored translucent glass or plastic rods; e.g., yellow, blue, and green rods arranged on the protective glass 1*g*.

The reference payout lines ht11, ht21, . . . htn1 may be embodied by means of imparting a special refraction factor to the protective glass 1*g* such that translucent colors; e.g., yellow, blue, and green, may be isolated in the form of rods by means of illumination.

Operating tables t1, t2, t3, t4, . . . tn having control buttons b1, b2, b3, b4, . . . bn provided thereon are disposed, in a sloped manner, at positions on the respective stations s1, s2, s3, s4, . . . sn where the players can readily operate the buttons. Payout receivers m1, m2, m3, m4, . . . mn for storing coins or tokens ejected from hoppers (not shown) by way of payout holes k1, k2, k3, k4, . . . tn are disposed at positions lower than the respective operating tables t1, t2, t3, t4, . . . so as to project forward from the wall face.

A symbol sheet on which the symbols 21, . . . are drawn and which is formed from polycarbonate or the like is affixed onto the peripheral face of the symbol reel 2; a symbol sheet on which the symbols 31, . . . are drawn and which is formed from polycarbonate or the like is affixed onto the peripheral face of the symbol reel 3; and a symbol sheet on which the symbols 41, . . . are drawn and which is formed from polycarbonate or the like is affixed onto the peripheral face of the symbol reel 4. Thus, the symbol reels 2, 3, and 4 display the symbols 21 . . . , the symbols 31 . . . , and the symbols 41 . . . to the players.

The symbols 21 . . . , the symbols 31 . . . , and the symbols 41 . . . are classified into symbols that would constitute a big winning combination; e.g., 7; symbols that would constitute a medium winning combination; symbols that would constitute a small winning combination; symbols that would constitute a bonus game; and remaining general symbols.

Outer shells of the respective symbol reels 2, 3, and 4 are formed from drums (not shown). With a view toward reducing the weight and inertia of the drums, lightweight material, such as an aluminum alloy or synthetic resin, is selected, thereby attempting weight reduction through, for example, a reduction in the thickness of constituent sections.

The spinning reels 2, 3, and 4 are rotated, by means of direct drive by stepping motors (not shown) which have good compatibility with a digital control system and rotate through only a preset angle. Position sensors (not shown) are adopted for stopping the spinning reels at predetermined positions, thereby effecting position control.

Position sensors that are employed are selected from optical sensors, such as photodiodes or phototransistors, or magnetic sensors utilizing electromagnetic induction, as required.

Needless to say, a transmission mechanism which employs transmission belts and gear mechanisms, as required, may be adopted for effecting rotation of the respective symbol reels 2, 3, and 4.

In order to enable players to easily view the symbols 21 . . . , the symbols 31 . . . , and the symbols 41 . . . , internal lamps (not shown) are provided within the respective symbol reels 2, 3, and 4 for illuminating symbols on the peripheral faces of the spinning reels from the inside thereof.

Incidentally, the symbols 21 . . . , the symbols 31 . . . , and the symbols 41 . . . are also illuminated from the outside of the spinning reels by external lamps (not shown).

In the embodiment, the symbol reels 2, 3, and 4 are constituted of mechanical reels having true-to-life characteristics, thereby displaying the symbols 21 . . . , the symbols 31 . . . , and the symbols 41 . . . . Here, the symbol reels may be constituted of symbol display devices for displaying the symbols of the plurality of symbol reels by images, such as an LCD (liquid-crystal display), a CRT (cathode-ray tube), or a DLP (digital light processing) projector using an image display device DMD (digital micro-mirror device).

Specifically, there may also be employed a symbol display system in which display sections (corresponding to the peripheral faces of the symbol reels 2, 3, and 4) are vertically stacked side by side into a plurality of layers, each section sequentially displaying images of a plurality of symbols in a circulatory manner by horizontally moving in the form of a row of predetermined sequence.

In the multi-station game machine 1 having the symbol display system for displaying images of the symbols, the outer circumferential face of the game machine 1 may assume an arbitrary shape other than the shape of a cylindrical face, such as an elliptic cylindrical shape.

Since the operating table t1 of the station s1 is identical in construction with the operating tables t2, to of the other stations s2, s3, s4, . . . sn, an explanation is given of only the operating table t1.

The operating table t1 is constituted of a display panel (individual display section) h1; a control button section b1 consisting of a plurality of types of control buttons; and a coin insert slot i1 into which coins or tokens are inserted.

The display panel h1 is constructed from a CRT display or an LCD and is used for displaying a bet time, an indication to be used when the player bets coins or tokens on the payout lines ht1, . . . during a period of bet time, the end of a bet time, and the symbols 21, 31, 41, . . . of the symbol reels 2, 3, 4 which are to spin after the bet time; and is used by the player for ascertaining the history of game results and the number of remaining coins or tokens.

Control buttons of the control button section 1*b* includes a line selection button to be used for selecting payout lines from the payout lines ht1 . . . and making the selected payout line valid; a bet button to be used for betting a coin or token one by one on the payout lines ht1 . . . that are selected and made valid; a maximum bet button to be used for betting a maximum number of coins or tokens on the payout lines ht1 . . . that are selected and made valid; a remaining credit check button; a credit payoff button; an employee call button, and other buttons as required. Predetermined processing is performed by a player pressing any of the buttons.

So long as a touch panel method is employed for the display panel h1, the panel may play the role of press buttons.

Figure 3:
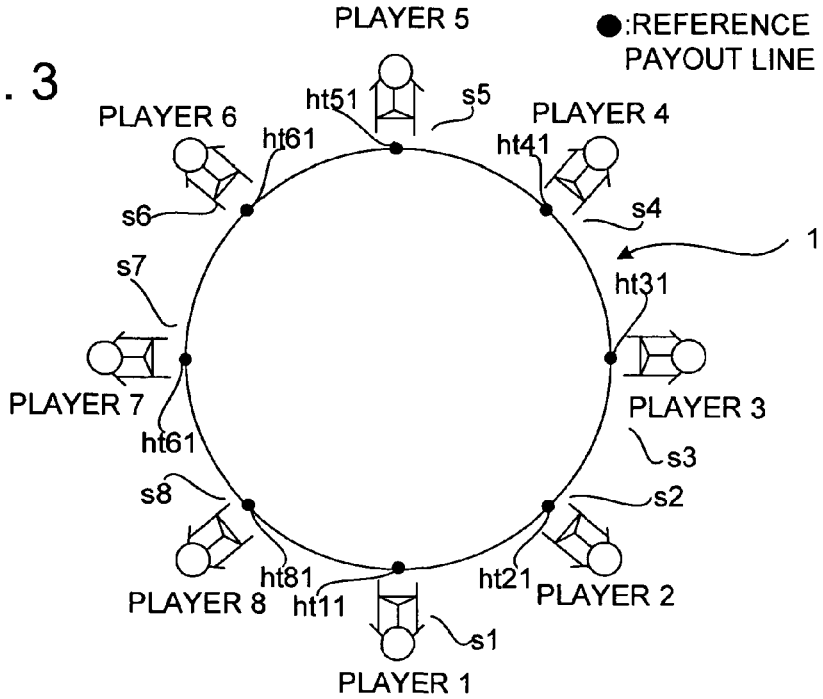
FIG. 3 is a conceptual plan view showing the layout of players when the multi-station game machine of the embodiment has eight stations.

As shown in FIG. 3, when the multi-station game machine 1 of the foregoing configuration has eight stations s1, s2, . . . S8 to be used by respective players, eight players can simultaneously enjoy playing a combination game.

Figure 4:
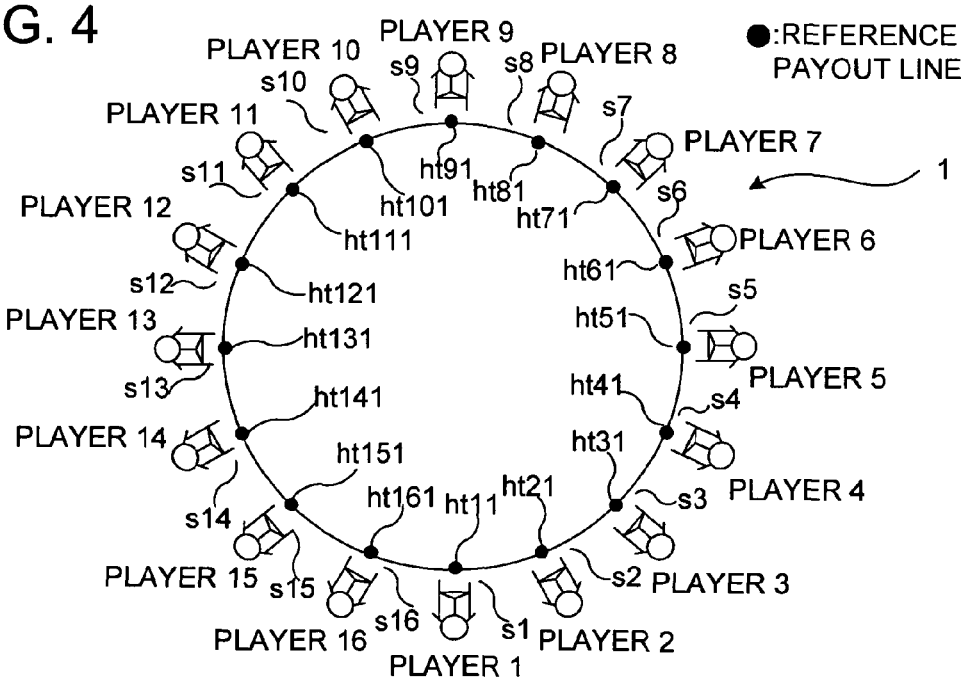
FIG. 4 is a conceptual plan view showing the layout of players when the multi-station game machine of the embodiment has 16 stations.

As shown in FIG. 4, when the multi-station game machine 1 has 16 stations, s1, . . . S16, 16 players can simultaneously enjoy playing a combination game. The number of stations can be selected as, for example, 10, 12, 14, . . . , as required.

Players equal in number to the stations can simultaneously enjoy playing a combination game.

Figure 5A:
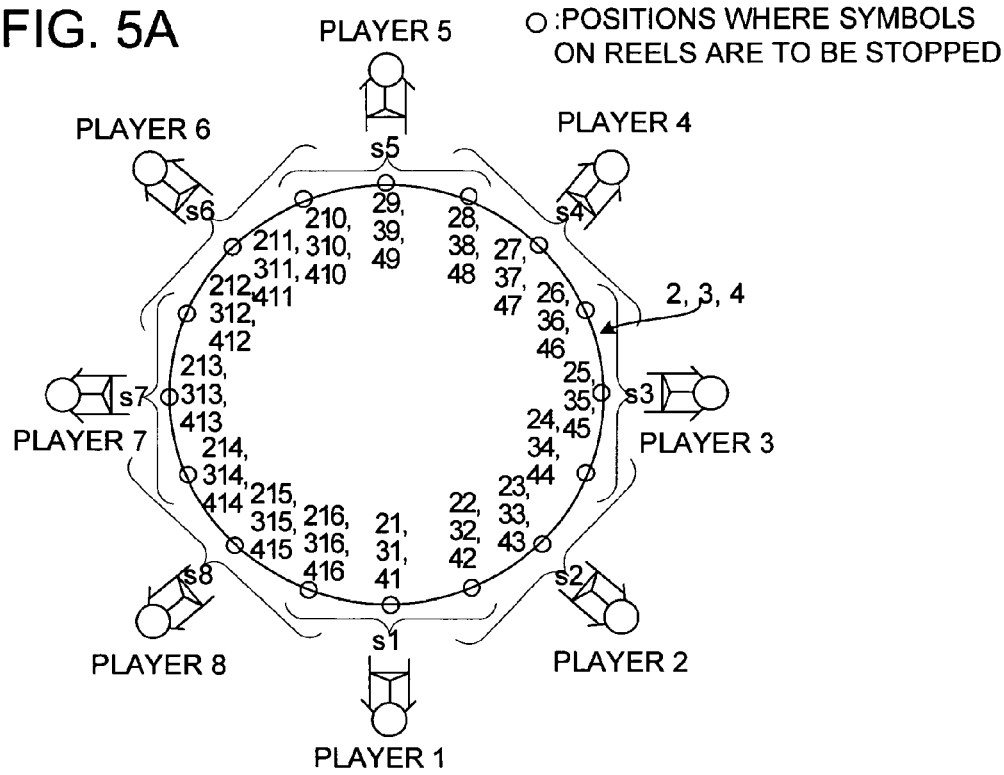
FIG. 5A is a conceptual plan view and FIG. 5B is a conceptual perspective view, both showing an example relative positional relationship between stations and positions where symbols on symbol reels are to be stopped when the multi-station game machine of the embodiment has eight stations and 16 symbols are provided on a peripheral face of each of the symbol reels.

For instance, the multi-station game machine 1 is designed to have eight stations s1 through s8 such that the symbol reel 2 has 16 symbols 21, 22, . . . 216 provided on a peripheral face thereof; such that the symbol reel 3 has 16 symbols 31, 32, . . . 316; and such that the symbol reel 4 has 16 symbols 41, 42, . . . 416. In such a case, the relative positional relationship between the stations and the stop positions of the symbols on the respective symbol reels 2, 3, and 4 can be set to that shown in FIG. 5A.

The symbols numbered 21, 22, . . . 216; the symbols numbered 31, 32, . . . 316; and the symbols numbered 41, 42, . . . 416 are assigned numbers for convenience of explanation; in practice, specific numbers are not designated.

Figure 5B:
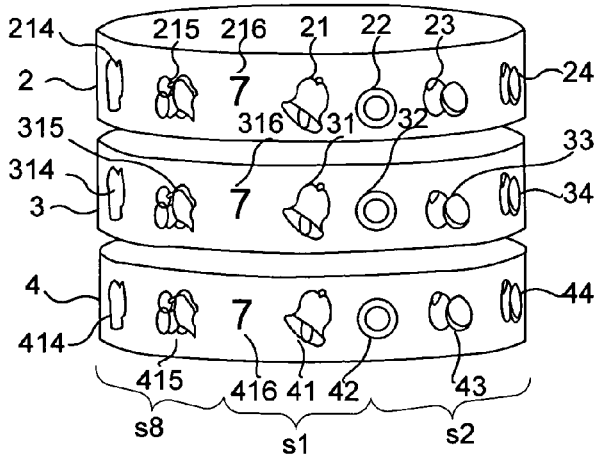

As can be seen from FIG. 5, the multi-station game machine 1 is arranged such that three of the 16 symbols 21, . . . 216 on the symbol reel 2, three of the 16 symbols 31, . . . 316 on the symbol reel 3, and three of the symbols 41, . . . , 416 on the symbol reel 4 are assigned to the respective stations s1, s2, . . . , sn when the spinning symbol reels 2, 3, and 4 are stopped.

More specifically, the symbols 216, 21, and 22 on the symbol reel 2, the symbols 316, 31, and 32 on the symbol reel 3, and the symbols 416, 41, and 42 on the symbol reel 4 are stopped at the station s1; the symbols 22, 23, and 24 on the symbol reel 2, the symbols 32, 33, and 34 on the symbol reel 3, and the symbols 42, 43, and 44 on the symbol reel 4 are stopped at the station s2; . . . , the symbols 214, 215, and 216 on the symbol reel 2, the symbols 314, 315, and 316 on the symbol reel 3, and the symbols 414, 415, and 416 on the symbol reel 4 are stopped at the station s8.

FIG. 6 shows an example of the multi-station game machine 1 in which payout lines ht11, ht12, and ht13 are available for the player of the station s1 with regard to the symbols on the stationary symbol reels 2, 3, and 4.

The station s8 is disposed on the left side of the station s1, and the station s2 is disposed on the right side of the station s1.

Figure 6A:
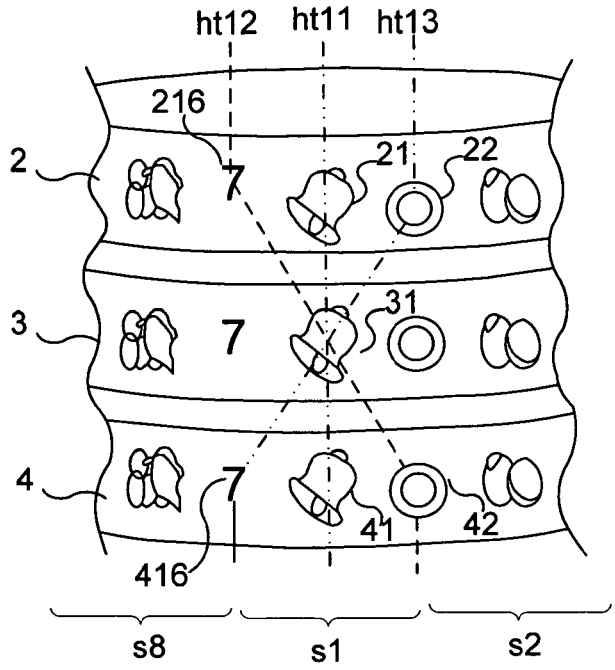
FIGS. 6A and 6B are perspective views of the multi-station game machine shown in FIG. 5, wherein 6A shows payout lines to be used for solely a station s1 and 6B shows shared payout lines to be shared between and used by the station s1 and adjacent stations.

FIG. 6A shows the payout lines ht11, ht12, and ht13 to be used solely for the station s1.

The payout line ht11 is a vertical straight payout line provided at the center of the station s1. In the case of symbols illustrated in FIG. 6A, the payout line ht11 is formed by combination of the symbol 21 on the symbol reel 2, the symbol 31 on the symbol reel 3, and the symbol 41 on the symbol reel 4.

The payout line ht12 is sloped downward from left to right on a display area of the station s1. In the case of the symbols illustrated in FIG. 6A, the payout line ht12 is constituted by combination of the symbol 216 on the symbol reel 2, the symbol 31 on the symbol reel 3, and the symbol 42 on the symbol reel 4.

The payout line ht13 is sloped downward from right to left on the display area of the station s1. In the case of the symbols illustrated in FIG. 6A, the payout line ht13 is constituted by combination of the symbol 22 on the symbol reel 2, the symbol 31 on the symbol reel 3, and the symbol 416 on the symbol reel 4.

Figure 6B:
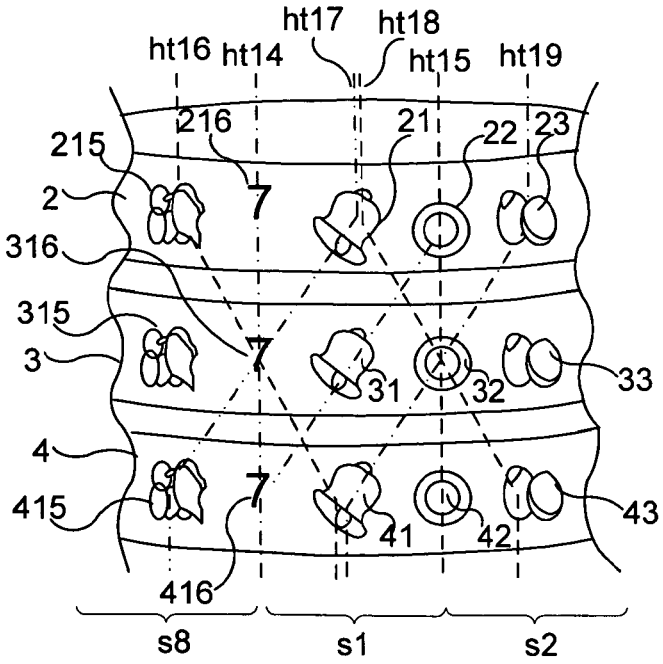

FIG. 6B shows payout lines ht14, ht16, and ht17 to be shared between the stations s1 and s8, and payout lines ht15, ht18, and ht19 to be shared between the stations s1 and s2.

The payout line ht14 is a straight, vertical payout line provided on the left side of the display area of the station s1 and is also used for the station s8. In the case of the symbols illustrated in FIG. 6B, the payout line ht14 is formed by combination of the symbol 216 on the symbol reel 2, the symbol 316 on the symbol reel 3, and the symbol 416 on the symbol reel 4.

The payout line ht16 is a sloped payout line provided on the display area of the station s1 and is also used for the station s8. In the case of the symbols illustrated in FIG. 6B, the payout line ht16 is formed by combination of the symbol 215 on the symbol reel 2, the symbol 316 on the symbol reel 3, and the symbol 41 on the symbol reel 4.

The payout line ht17 is a sloped payout line provided on the display area of the station s1 and is also used for the station s8. In the case of the symbols illustrated in FIG. 6B, the payout line ht16 is formed by combination of the symbol 21 on the symbol reel 2, the symbol 316 on the symbol reel 3, and the symbol 415 on the symbol reel 4.

The payout line ht15 is a straight, vertical payout line provided on the right side of the display area of the station s1 and is also used for the station s2. In the case of the symbols illustrated in FIG. 6B, the payout line ht15 is formed by combination of the symbol 22 on the symbol reel 2, the symbol 32 on the symbol reel 3, and the symbol 42 on the symbol reel 4.

The payout line ht18 is a sloped payout line provided on the display area of the station s1 and is also used for the station s2. In the case of the symbols illustrated in FIG. 6B, the payout line ht18 is formed by combination of the symbol 21 on the symbol reel 2, the symbol 32 on the symbol reel 3, and the symbol 43 on the symbol reel 4.

The payout line ht19 is a sloped payout line provided on the display area of the station s1 and is also used for the station s2. In the case of the symbols illustrated in FIG. 6B, the payout line ht19 is formed by combination of the symbol 23 on the symbol reel 2, the symbol 32 on the symbol reel 3, and the symbol 41 on the symbol reel 4.

As mentioned previously, the payout lines ht14, ht16, ht17 shared between the station s1 and the adjacent station s8 and the payout lines ht15, ht18, ht19 shared between the station s1 and the adjacent station s2 are particularly designated as shared payout lines.

More specifically, among payout lines, those shared between two adjacent stations are called shared payout lines.

For station s1, the payout lines ht11 through ht19, including the shared payout lines, are provided. However, other payout lines, including other shared payout lines, can also be provided.

Payout lines including shared payout lines analogous to those employed in the station s1 are used even in stations s2, s3, s4, s5, s6, s7, and s8.

The reference payout lines ht11, ht21, ht31, . . . htn1 provided for the respective stations s1, s2, . . . sn are embodied by adoption of center vertical payout lines in the respective stations from among the previously-described payout lines as reference payout lines.

The reference payout lines ht11, ht21, ht31, . . . htn1 are not necessarily embodied by the center vertical payout lines of the respective stations. However, adoption of the center vertical payout lines is more preferable, for explicitly representing the respective stations s1, s2, . . . sn.

In the embodiment, the payout lines ht12, ht13, . . . other than the reference payout lines ht11, ht21, ht31, . . . htn1, which are to be offered to respective players, are drawn on the protective glass 1g.

A celebratory payout and a shared bonus payout are set as payouts to be provided when a win is achieved at any of the shared payout lines ht14, ht16, ht17, ht15, ht18, and ht19 by a winning combination.

In the case of the related game machine, when a winning is achieved as a result of symbols on the symbol reels that would constitute a winning combination which are aligned with a payout line on which the player does not bet coins or tokens, nothing is paid to the player.

In contrast, in the multi-station game machine 1, even when a player does not bet any coins or tokens on a shared payout line in advance before start of a game, if another player playing at an adjacent station bets coins or tokens on that shared payout line before initiation of the game, and if a win is achieved on the shared payout line as a result of start of the game, coins or tokens are paid to the player who bets coins or tokens as a reward for achievement of a win. In addition, coins or tokens are also paid to the player who does not bet coins or tokens, as a celebratory payout.

For example, as shown in FIG. 5, a player 1 who is playing games at the station s1 is assumed not to bet any coins or tokens on the shared payout line ht15 between the stations s1 and s2, which is shown in FIG. 6B, in advance before start of a game.

Provided that a player 2 playing at the station s2 bets coins or tokens on the shared payout line ht15 in advance before start of a game, if symbols that constitute a winning combination are aligned along the shared payout line ht15 as a result of the spinning symbol reels 2, 3, 4 that are stopped after start of a game, to thereby achieve a win, coins or tokens corresponding to a reward for achievement of a win along the shared payout line ht15 are paid to the player 2. Further, coins or tokens are also paid to the player 1 who does not bet any coins or tokens on the shared payout line ht15, as a celebratory payout associated with achievement of a win along the shared payout line ht15.

As in the case of the shared payout line ht15, a celebratory payout is also provided even on other shared payout lines.

Next will be described the shared bonus payout. In this example situation, a player bets coins or tokens on a shared payout line in advance before start of a game, and another player playing at an adjacent station also bets coins or tokens on that shared payout line in advance before start of a game. If both player bet coins or tokens on the same shared payout line and if a win is achieved along the shared payout line on which the players bet coins or tokens, after start of a game, coins or tokens corresponding to a reward for achievement of a win on the shared payout line are paid to both players. In addition, a bonus payout is also paid to both players as a shared bonus payout.

For example, as shown in FIG. 5, the player 1 playing at the station s1 is assumed to bet coins or tokens on the payout line ht16, which is shared between the stations s1 and s8 and is shown in FIG. 6B, in advance before start of a game. The player 8 playing at the station s8 is also assumed to bet coins or tokens on the shared payout line ht16 in advance before start of a game.

If the game is started and a win is achieved as a result of symbols that constitute a winning combination that are aligned along the shared payout line ht16 after the spinning symbol reels 2, 3, and 4 are stopped, a payout corresponding to a reward for achievement of a win is paid to the players 1 and 8. In addition, a bonus payout is paid to the players 1 and 8 as a shared bonus payout.

Even on the remaining shared payout lines, a shared bonus payout is paid as in the case of the shared payout line ht16.

As mentioned above, the celebratory payout and the shared bonus payout to be paid to the player 1 are described as examples of payouts to be paid when a winning combination are established along a shared payout line. Needless to say, under similar conditions, the celebratory payout and the bonus payout are paid to the other players 3, 4, . . . 8 in the same manner.

Figure 7:
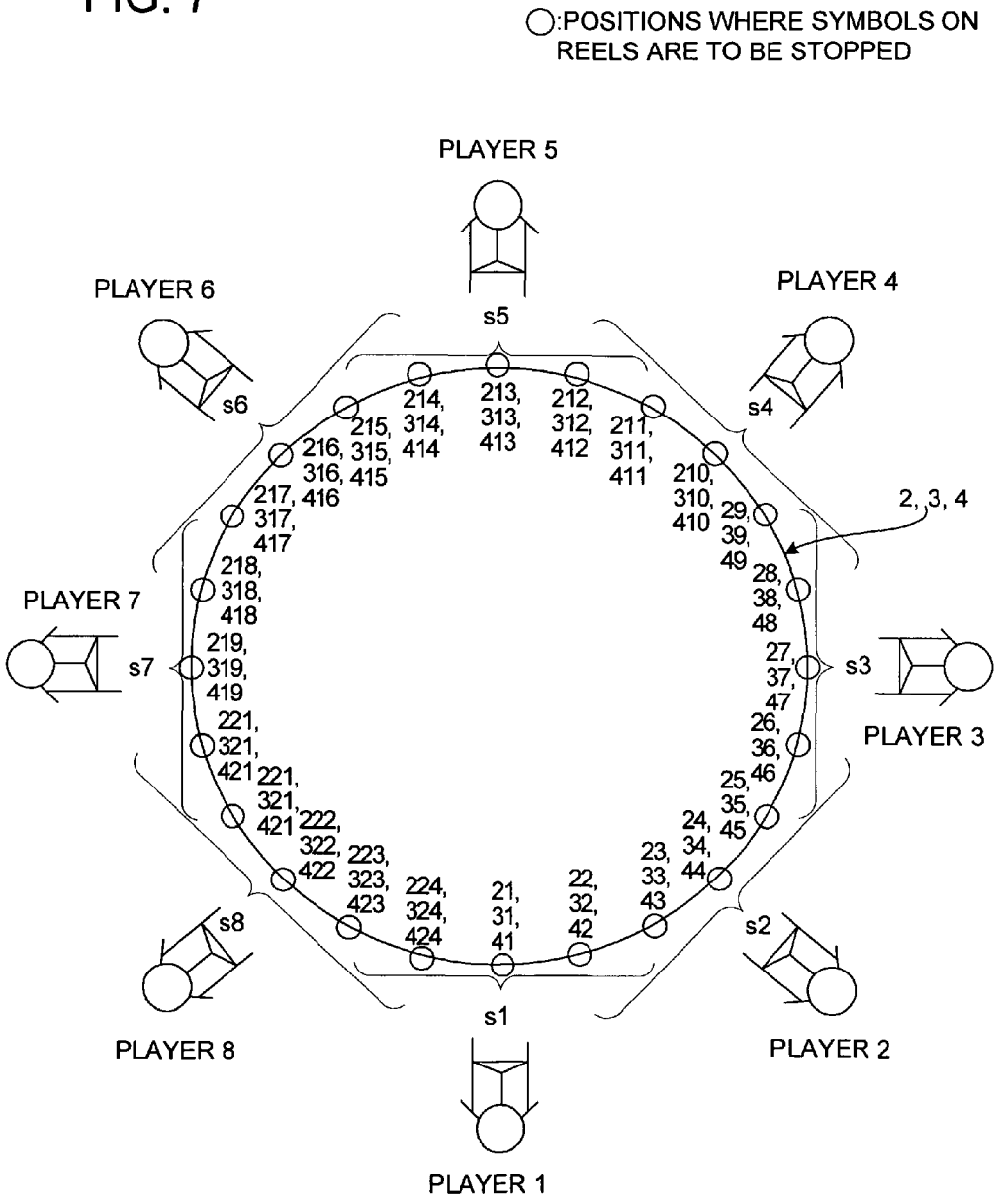
FIG. 7 is a conceptual plan view of the multi-station game machine of the embodiment, showing an example of a relative positional relationship between stations and positions where symbols on symbol reels are to be stopped when eight stations are provided and 24 symbols are provided on the peripheral face of each of the symbol reels.

A multi-station game machine 1 shown in FIG. 7 is an example of game machine having stations s1, s2, . . . s8 which enable eight players to simultaneously enjoy playing a combination game. In this example, symbols 21, 22, . . . 224 are provided on the peripheral face of the symbol reel 2; symbols 31, 32, . . . 324 are provided on the peripheral face of the symbol reel 3; and symbols 41, 42, . . . 424 are provided on the peripheral face of the symbol reel 4.

As can be seen from FIG. 7, symbols 223, 224, 21, 22, 23 on the symbol reel 2, symbols 323, 324, 31, 32, 33 on the symbol reel 3, and symbols 423, 424, 41, 42, 43 on the symbol reel 4 are stopped on the station s1 of the multi-station game machine 1; symbols 22, 23, 24, 25, 26 on the symbol reel 2, symbols 32, 33, 34, 35, 36 on the symbol reel 3, and symbols 42, 43, 44, 45, 46 on the symbol reel 4 are stopped displayed on the station s2 of the multi-station game machine 2; . . . , similarly, symbols 220, 221, 222, 223, 224 on the symbol reel 2, symbols 320, 321, 322, 323, 324 on the symbol reel 3, and symbols 420, 421, 422, 423, 424 on the symbol reel 4 are stopped on the station s8 of the multi-station game machine 1.

More specifically, the game machine is set such that five symbols of the symbols 21 . . . on the symbol reel 2, five symbols of the symbols 31 . . . on the symbol reel 3, and five symbols of the symbols 41 . . . on the symbol reel 4 are assigned to respective stations s1, s2, . . . s8 when the spinning symbol reels 2, 3, 4 are stopped.

Even in the multi-station game machine of the embodiment, payout lines including shared payout lines are produced. In addition to a basic payout to be paid for establishment of a winning combination, the celebratory payout and the shared bonus payout are paid for the shared payout lines.

Figure 8:
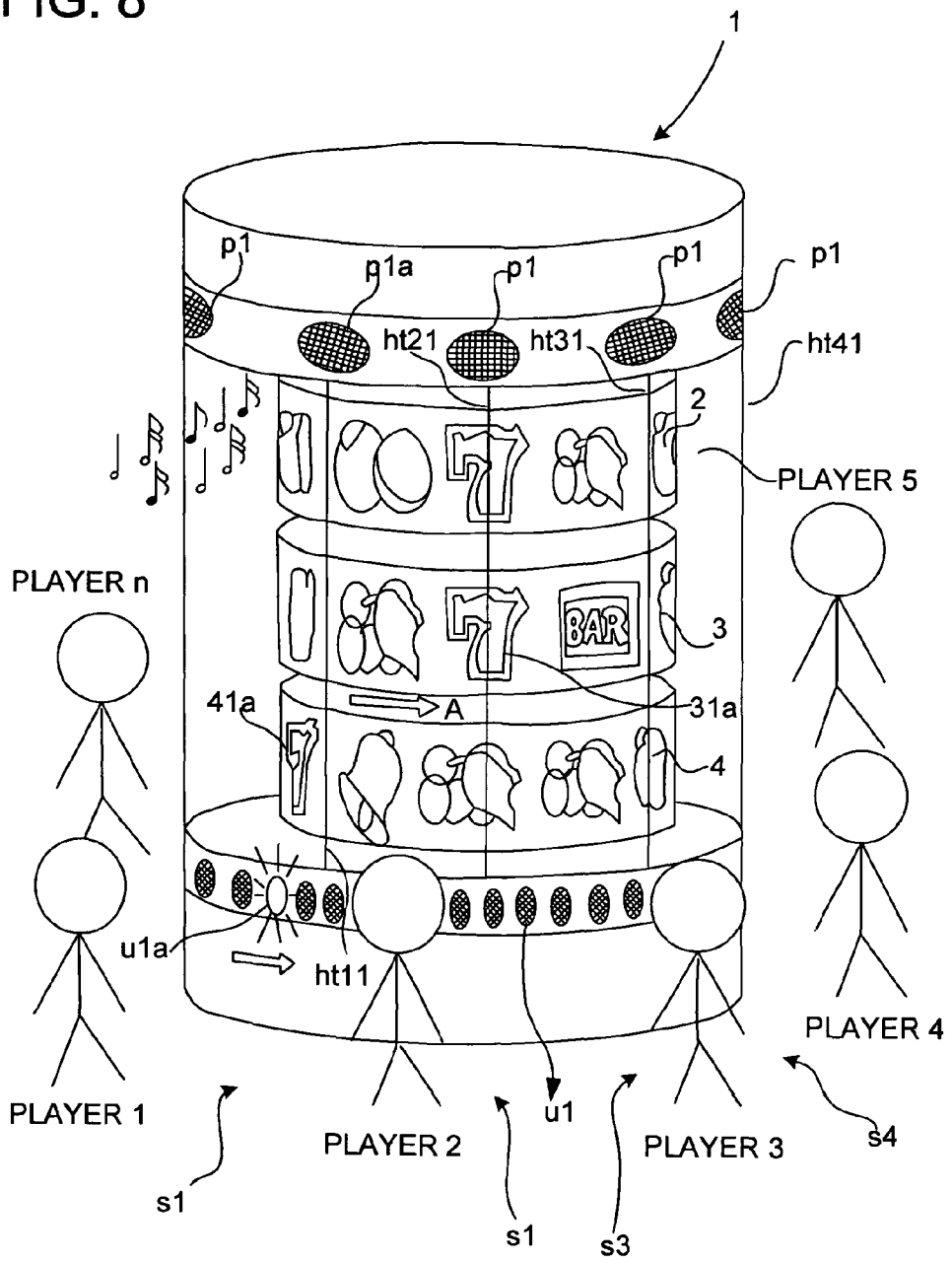
FIG. 8 is a conceptual perspective view showing that predetermined symbols that would constitute a winning combination are already aligned with a payout line while a symbol which would constitute a winning combination along with the predetermined symbols remains, and that a symbol reel having a final symbol which is not determined is spinning.

As shown in FIGS. 1 and 8, in the multi-station game machine 1, a plurality of speakers p1 and a plurality of game lamps 1 are provided around the symbol reels 2, 3, and 4. In association with rotations of the symbols 21 . . . on the symbol reel 2, the symbols 31 . . . on the symbol reel 3, and the symbols 41 . . . on the symbol reel 4 performed during games, game sound effects are emitted from the speakers p1; sound images are caused to go around the game machine; optical game effects are emitted from the game lamps u1; and illuminated light or blinking light is caused to go around the game machine, to thereby enable presentation of a game which provides audiovisual stimulation.

An explanation is now given of revolving of sound images and revolving of illumination light or blinking light. When a winning combination is established by symbols determined by internal random selection or a result of combination of symbols, game sound effects are emitted from the speakers p1, sound images are caused to go around the game machine, optical game effects are emitted from the game lamps u1, and illumination light or blinking light is caused to go around the game machine, as an advance notice of establishment of a winning combination, along with rotation of symbols on the peripheral face of any one of the symbol reels 2, 3, 4 which are currently spinning and are to be stopped next.

As establishment of a winning combination which involves emission of the game sound effects and optical game effects, establishment of a big winning combination, establishment of a medium winning combination, establishment of a small winning combination, and establishment of a bonus game is selected, as required, and the thus-selected winning combination is applied.

As establishment of a winning combination other than those set forth, there is selected and applied, as required, establishment of a winning combination involving a payout of predetermined number of bills or predetermined amount of money; e.g., a payout of 50 bills or more, a payout of 100 bills or more, a payout of 1000 bills or more, a payout of 100 dollars or more, or a payout of 1000 dollars or more, or a payout of an arbitrary number of bills or an arbitrary amount of money.

Here, a case where establishment of a big winning combination (involving the maximum payout) is determined by means of internal random selection is now illustrated. As shown in FIG. 8, which is a conceptual rendering of players in the course of playing a game, game sound effects are emitted from the speaker p1 located close to a symbol 21*a* (a symbol involving a maximum payout) on the symbol reel 2 of the spinning symbol reels 2, 3, 4, in a situation where the symbol reel 2 is to be stopped first and the symbol 21*a* would constitute a big winning combination (hereinafter simply called a "big win symbol 21*a*"), and sound images are caused to go around the game machine. Moreover, optical game effects are emitted from the game lamp u1 located close to the big win symbol 21*a*, and illumination light or blinking light goes around the game machine.

After the symbol reel 2 is stopped, game sound effects are emitted from the speaker p1 located close to a symbol 31*a* (a symbol involving a maximum payout) on the symbol reel 3 of the spinning symbol reels 2, 3, 4, in a situation where the symbol reel 3 is to be stopped second and the symbol 31*a* would constitute a big winning combination (hereinafter simply called a "big win symbol 31*a*"), and sound images are caused to go around the game machine. Moreover, optical game effects are emitted from the game lamp u1 located close to the big win symbol 31*a*, and illumination light or blinking light goes around the game machine.

After the symbol reel 3 is stopped, game sound effects are emitted from a speaker p1*a* located close to a symbol 41*a* (a symbol involving a maximum payout) on the symbol reel 4 of the spinning symbol reels 2, 3, 4, in a situation where the symbol reel 4 is to be finally stopped and the symbol 41*a* would constitute a big winning combination (hereinafter simply called a "big win symbol 41*a*"), and sound images are caused to go around the game machine. Moreover, optical game effects are emitted from a game lamp u1*a* located close to the big win symbol 41*a*, and illumination light or blinking light goes around the game machine.

There may also be adopted, as required, a presentation of changing the sound of or increasing the volume of the game sound effects emitted from the speaker p1*a* located close to the big win symbol 41*a* on the symbol reel 4 to be stopped finally in relation with those emitted for the symbol reels 2, 3. Thus the game sound effects with reference to the symbol reel 4 is stopped finally are different from the game sound effects emitted for the symbol reel 4 from those emitted for the symbol reels 2, 3.

Similarly, there may also be adopted, as required, a presentation of changing the hue of or increasing the saturation or brightness of the optical game effects emitted from the game lamp u1*a* located close to the big win symbol 41*a* on the symbol reel 4 to be stopped finally in relation with those emitted for the symbol reels 2, 3. Thus the optical game effects with reference to the symbol reel 4 are different from the optical game effects emitted for the symbol reel 4 from those emitted for the symbol reels 2, 3.

A presentation other than those set forth may also be employed. As shown in FIG. 8, for example, establishment of a big winning combination is assumed to be established by the internal random selection. The big win symbol 21*a* on the symbol reel 2 are aligned with and stopped at the reference payout line ht21 of the station s2. Subsequently, the big win symbol 31*a* on the symbol reel 3 are aligned with and stopped at the reference payout line ht31 of the station s3. Finally, the symbol reel 4 is spinning in the direction of arrow A. In such a situation, sound effects for establishment of a big winning combination are emitted from the speaker p1*a* located close to the big win symbol 41*a* in association with rotation of the big win symbol 41*a* on the symbol reel 41. In addition, attractive optical effects for establishment of a big winning combination are emitted from the game lamp u1*a* located close to the big win symbol 41*a*, thereby enabling presentation for causing sound images and illumination light or blinking light to go around the game machine.

In this way, when the two big win symbols 21*a*, 31*a* are already aligned with the payout line ht21 and the symbol reel 4 is not stopped for display and is still spinning, sound images for establishment of a big winning combination and optical effects or blinking light for establishment of a big winning combination are caused to go around the game machine in association with the spinning action of the big win symbol 41*a* on the symbol reel 4. Thus, the interest of the player who is expected to benefit from a big winning combination is enhanced more and more.

In the example, when establishment of a big winning combination is determined by the internal random selection, sound effects for establishment of a big winning combination are emitted from the speaker p la located close to the big win symbol 41*a* in association with spinning action of the big win symbol 41*a* on the symbol reel 4. Attractive optical effects for establishment of a big winning combination are emitted from the game lamp u1*a* located close to the big win symbol 41*a* in association with spinning action of the big win symbol 41*a* on the symbol reel 4. Needless to say, the foregoing configuration can also be applied to establishment of a winning combination other than a big winning combination; e.g., establishment of a medium winning combination, establishment of a small winning combination, establishment of a bonus game (i.e., a second game), or establishment of a winning combination involving a payout higher than a predetermined payout.

In relation to presentation of the game sound effects and optical game effects, effects to be emitted may be limited to only game sound effects or only optical game effects. Alternatively, both the game sound effects and the optical game effects may be emitted in conjunction with each other.

Figure 9:
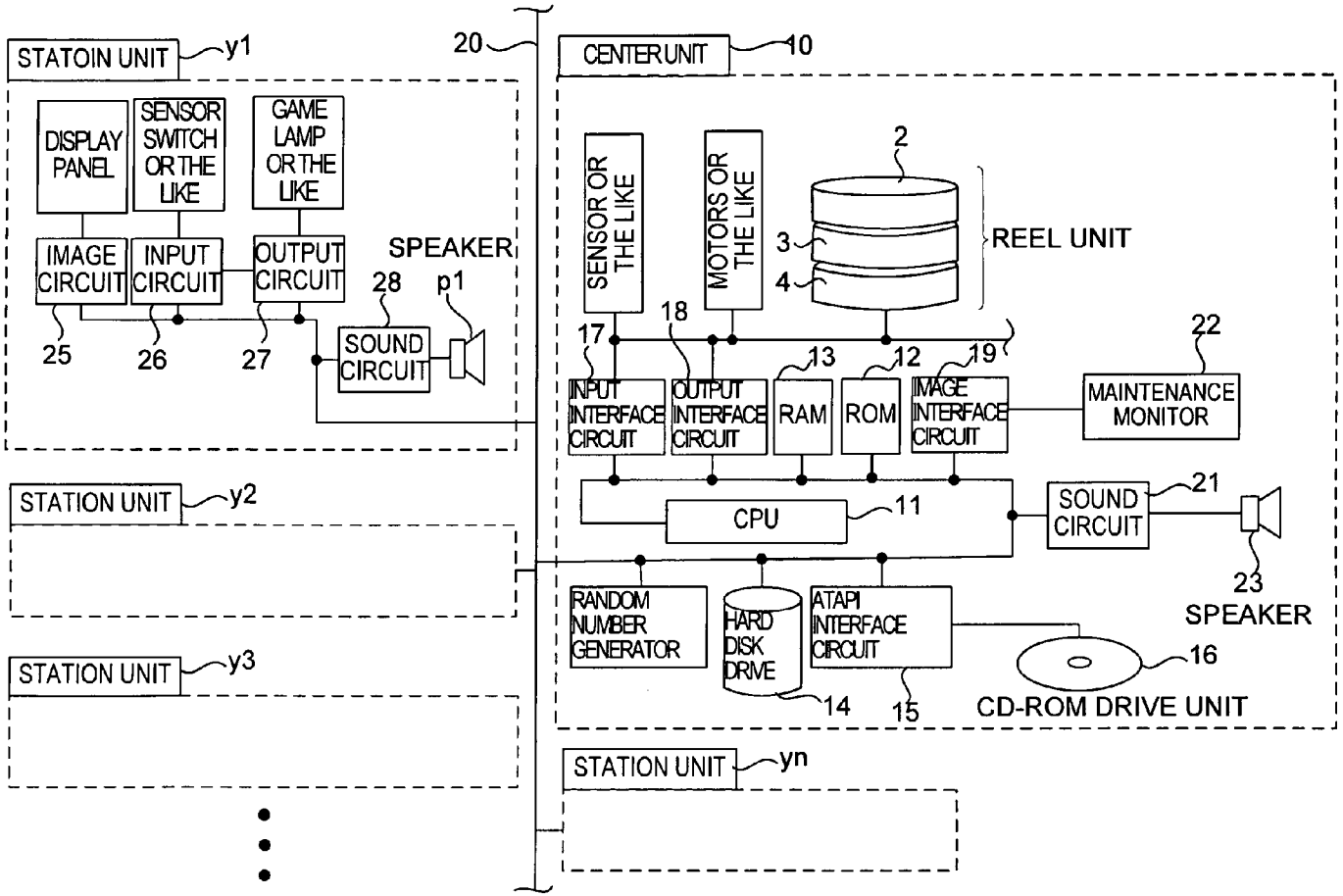
FIG. 9 is a block diagram showing a control configuration of a multi-station game machine according to the embodiment of the invention.

Control configuration of the multi-station game machine 1 will now be described by reference to FIG. 9.

Control of the multi-station game machine 1 is configured such that a center unit 10 controlling the overall game machine in accordance with a stored control program is connected with station units y1, y2, . . . yn which are disposed so as to correspond to the respective stations s1, s2, s3, s4, . . . sn and control sections of the respective stations s1, s2, s3, s4, . . . sn, the control sections exchanging control signals with the center unit 10, transmitting output data, and receiving input data, by way of a system bus 20 of 16-bit or 32-bit width.

The station units y1, y2, . . . , yn are of identical configuration.

The center unit 10 is configured by means of connecting together, by way of the system bus 20, a CPU (central processing unit) (also called a game speaker controller and a game lamp controller) 11 which serves as a central processing unit; ROM (read-only memory) 12, which is non-volatile memory; RAM (random-access memory) 13, which is volatile memory; a hard disk drive 14 having a large storage capacity; a CD-ROM drive 16 connected to the center unit 10 by way of an ATAPI (advanced technology attachment packet interface) interface circuit 15; and interface circuits 17, 18, 19, 21.

The ROM 12 has control data or a table to be used for controlling rotation and stoppage of the symbol reels 2, 3, and 4 through use of a timer (not shown).

The table stored in the ROM 12 includes, e.g., a table for controlling stoppage of symbol reels; a table having combinations of symbols that would constitute winning combinations (hereinafter simply called a "win achievement symbol combination table"); a speaker position table; and a game lamp position table.

In the stop control table to be used for controlling stoppage of the symbol reels, symbols on the symbol reels 2, 3, 4 and their arrangements are recorded in an associated manner. When a relative positional relationship between a symbol on the symbol reel 2, a corresponding symbol on the symbol reel 3, and another corresponding symbol on the symbol reel 4 are determined, relative positional relationships between other symbols are determined automatically.

For instance, when 16 symbols are provided on each of the symbol reels 2, 3, and 4, symbol codes 1 through 16 are appended to respective symbols on the symbol reels 2, 3, and 4. A relative positional relationship between other symbols is recognized by reference to the symbols on the symbol code 1, thereby controlling stoppage of the symbol reels 2, 3, and 4.

Here, establishment of a winning combination by means of the symbols on the symbol reels 2, 3, and 4 that are stopped is determined by use of random numbers generated at predetermined probabilities by means of a random number generator consisting of a hardware counter. The random number generator may be constituted by use of software.

Stored in the win achievement symbol combination table are data pertaining to symbols which are to be aligned along the payout lines ht1 . . . and determine establishment of a bonus game. Moreover, stored in the table are data pertaining to the number of coins or tokens to be supplied to a player in accordance with establishment of various winning combinations.

The speaker position table is a table on which are recorded positions of the speakers 1*p* of the multi-station game machine 1.

The game lamp position table is a table on which are recorded positions of the game lamps u1 of the multi-station game machine 1.

A control program to be used for controlling the overall multi-station game machine 1 is recorded on the ROM 12. The control program is used for driving stepping motors and controlling stop positions of the respective stepping motors, the motors being used for spinning the symbol reels 2, 3, and 4; controlling hoppers to be used for paying out coins or tokens; performing processing for betting coins or tokens on any of the payout lines ht1 . . . ; ascertaining the number of remaining coins or tokens; ascertaining game results; operation control for blinking the game lamps u1 . . . ; and control for outputting sound to the speakers p1 . . . .

Here, the control program is manufactured by use of C language. However, the program may be produced by use of assembler language.

A work area to be used for executing the control program is generated in the RAM 13, or variable data are temporarily stored in the RAM 13.

More specifically, stored in the RAM 13 are data pertaining to the number of coins or tokens inserted into and paid out of the respective stations s1, s2, s3, s4, . . . , and a total number of coins or tokens inserted into and paid out from the respective stations.

By means of executing the program stored in the ROM 12, the CPU 11 controls the respective stepping motors to be used for spinning the symbol reels 2, 3, 4 and the overall multi-station game machine 1, such as various processing operations corresponding to input operations of players.

Stored in the hard disk drive 14 are data pertaining to results of games played at the respective stations and a history of game results.

The CD-ROM drive 16 is used for loading CD-ROMs having image data or the like recorded thereon into display panels of the respective stations s1, s2, s3, s4, . . . sn, or for loading CD-ROMs having a control program of updated version stored therein at the time of installation of the control program of updated version.

An input interface circuit 17 functions as an input interface for inputs from position sensors or the like for sensing positions of the symbol reels 2, 3, 4, and an output interface circuit 18 functions as an output interface for outputs, such as control signals, from the CPU 11 to the stepping motors of the respective symbol reels 2, 3, 4.

A maintenance monitor 22 is a monitor to be used by a game machine manager for performing maintenance on the multi-station game machine 1. A display section of the maintenance monitor 22 is constituted of a CRT or an LCD.

An image interface circuit 19 functions as an output interface for outputting an image signal from the CPU 11. The image interface circuit 19 outputs the image signal input from the CPU 11 to the maintenance monitor 22 by means of expansion and digital-to-analog conversion of the image data.

An audio interface circuit 21 is an output interface for outputting an audio signal output from the CPU 11 to a speaker 23 as an audio signal by means of decoding the audio signal.

As mentioned above, the station units y1, y2, . . . yn are of identical configuration, and hence an explanation is now given of only the station unit y1.

The station unit y1 plays the role of an output interface for outputting an image signal output from the CPU 11 to the display panel h1 which displays progress in a game and a player's operation.

An image circuit 25 outputs the image signal transmitted from the CPU 11 to the display panel h1 as image information by means of expansion and digital-to-analog conversion of the image signal.

An input circuit 26 provided in the station unit y1 is an input interface for inputting, into the CPU 11, a signal output from a sensor, such as a coin sensor (not shown) for sensing coins or tokens inserted by way of a coin insert slot i1, or a signal output from a switch, such as a button switch to be turned on when a button of a control button section b1 is pressed.

An output circuit (game lamp controller) 27 disposed in the station unit y1 is an output interface for outputting the signal delivered from the CPU 1 to the game lamps u1 . . . , which lamps emit optical game effects, or to a hopper or the like which pays out coins or tokens, and is constituted of an amplifying circuit or the like.

A sound circuit (game speaker controller) 28 disposed at the station unit y1 is an output interface for outputting an audio signal, which is delivered from the CPU 11 to the speaker p1, to the speaker p1 as an audio signal through decoding.

Next will be described control processing of the multi-station game machine 1 in each of game modes (see FIGS. 1, 2, 8, and 9).

Here, control processing of the multi-station game machine 1 is performed by means of execution of the control program recorded on the ROM 12.

Game modes of the multi-station game machine 1 are generally divided into a game when power is turned on, a normal game, and a bonus game.

When power of the multi-station game machine 1 is turned on, systems disposed in the center unit, such as the ROM 12, the RAM 13, and the hard disk drive 14, are inspected.

Next, the control program loads image data from the CD-ROM loaded in the CD-ROM drive 16 and transmits the image data to the respective image circuits 25 of the station units y1, y2, y3, y4, . . . by way of the system bus 20.

The respective image circuits 25 of the station units y1, y2, y3, y4, . . . which are received image data output image information to the respective display panels h1 . . . , whereby a game image appears on each of the display panels h1

When a normal game is started, a control program is executed, whereupon a symbol reel drive signal is transmitted to the stepping motors from the CPU 11 to the output circuit 18, to thereby start spinning of the symbol reels 2, 3, and 4.

Information about positions of the symbols on the spinning symbol reels 2, 3, and 4 is transmitted to the respective image circuits 25 of the station units y1, y2, y3, y4, . . . , and the image circuits 25 output image information to the respective display panels h1 . . . .

The display panels h1 . . . into which the image information is input display the symbols 21 . . . on the spinning symbol reel 2, the symbols 31 . . . on the spinning symbol reel 3, and the symbols 41 . . . on the spinning symbol reel 4.

Concurrently, bet time information is transmitted to the respective image circuits 25 of the stations units y1, y2, y3, y4, . . . from the CPU 11. A bet time information screen appears on the respective display panels h1, . . . of the stations s1, s2, s3, s4, . . . sn, thereby informing respective players of a bet time.

On the bet time information screen, each of the players bets a desired number of coins or tokens inserted for each of the desired payout lines ht11, . . . .

More specifically, each of the players selects desired payout lines from the payout lines ht11 . . . appearing on the bet time information screen by means of pressing a line selection button of the control button section b1. The player presses a bet button or maximum bet button of the control button section b1, to thereby display a desired number of coins or tokens from among the coins or tokens inserted on the bet time information screen and then bets the desired number of coins or tokens.

A line selection input signal output from a button switch of a line selection button and a number-of-bets set input signal output from a bet button or a button switch for the maximum bet button are transmitted to the CPU 11 as bet setting input signals by way of the input circuit 26.

Upon receiving the bet setting input signals for the respective stations s1, s2, s3, s4, . . . sn, the CPU 11 records the signals as bet information in the RAM 13 or the hard disk drive 14 for respective stations s1, s2, s3, s4, . . . sn.

Needless to say, the maximum number of coins or tokens to be bet, which is set by the maximum bet button, can be arbitrarily set; for example, to 10, 12, . . . .

When a predetermined period of bet time counted by the timer is ended, the CPU 11 transmits bet time end information to the display panels h1 . . . of the respective stations s1, s2, s3, s4, . . . sn, and the information appears on the display panels h1 . . . , whereupon the bet time information screen is terminated.

As a result, only the symbols 21 . . . on the spinning symbol reel 2, the symbols 31 . . . on the spinning symbol reel 3, and the symbols 41 . . . on the spinning symbol reel 4 appear on the display panels h1 . . . .

Concurrently, the following control operation is performed, as required. Namely, the CPU 11 sequentially transmits an audio signal to the speakers p1 . . . by way of an sound circuit 28. In accordance with spinning actions of the symbols 21 . . . on the symbol reel 2, the symbols 31 . . . on the symbol reel 3, and the symbols 41 . . . on the symbol reel 4, game sound effects are emitted from the speakers p1, and sound images are caused to go around the game machine.

After a predetermined period of time counted by the timer since the end of the bet time, spinning actions of the symbol reels 2, 3, and 4 are sequentially stopped by use of the timer.

Here, when establishment of a winning combination is determined by symbols, or as a result of combination of symbols through internal random selection, the symbols which are to constitute a winning combination and their positions on the symbol reels 2, 3, and 4 are grasped by use of the win achievement symbol combination table, the stop control table, and the position sensors. Then, there is performed, as required, a presentation of emitting game sound effects from the speaker p1 located close to the symbols which are to constitute a winning combination on the symbol reels 2, 3, 4, thereby causing sound images to go around the game machine, emitting optical game effects from the game lamp u1 located close to the symbols which are to constitute a winning combination, and causing illumination light or blinking light to go around the game machine.

For example, when establishment of a winning combination is determined by symbols, or as a result of combination of symbols through internal random selection, game sound effects are emitted from the speaker p1 located close to the symbols which are to constitute a winning combination and provided on any of the symbol reels 2, 3, 4, the reels being currently spinning and to stop; sound images are caused to go around the game machine; optical game effects are emitted from the game lamp u1 located close to the symbols that are to constitute a winning combination; and illumination light or blinking light is caused to go around the game machine.

Alternatively, when establishment of a big winning combination is determined by symbols, or as a result of combination of symbols through internal random selection, the following presentation is performed: namely, game sound effects for establishment of a big winning combination are emitted from the speaker p1*a* located close to the big win symbol 41*a* on the symbol reel 4, the reel still spinning after the symbol reels 2 and 3 are stopped; sound images are caused to go around the game machine; optical game effects for establishment of a big winning combination are emitted from the game lamp uta located close to the big win symbol; and illumination light or blinking light is caused to go around the game machine.

As shown in FIG. 8, establishment of a big winning combination is assumed to be determined by symbols or as a result of combination of symbols through internal random selection. The big win symbol 21*a* on the symbol reel 2 is assumed to be stopped and aligned with the reference payout line ht21 of the station s1. Subsequently, the big win symbol 31*a* on the symbol reel 3 is assumed to be stopped and aligned with the reference payout line ht21. The symbol reel 4 which are not stopped and whose symbol to be stopped is not yet determined is assumed to still be spinning in the direction of arrow A. Under these circumstances, the CPU 11 recognizes that the big win symbol 21*a* on the symbol reel 2 and the big win symbol 31*a* of the symbol reel 3 are stopped and aligned with the reference payout line ht21, through use of the stop control table stored in the ROM 12.

Subsequently, the CPU 11 grasps the spinning position of the big win symbol 41*a* of the symbol reel 4 by use of the position sensor for the symbol reel 4 and the stop control table stored in the ROM 12.

The CPU 11 determines the speaker 1*a* and the game lamp u1*a* located most close to the spinning position of the big win symbol 41*a*, by use of the speaker position table and the game lamp position table.

The CPU 11 transmits a game sound effect signal to the speaker p1*a* by way of the sound circuit 28 of the station (i.e., any one of the stations s1, s2, s3, s4, . . . sn) where the speaker p1*a* is located.

Similarly, the CPU 11 transmits an optical game effect signal to the speaker u1*a* by way of the output circuit 27 of the station (i.e., any one of the stations s1, s2, s3, s4, . . . sn) where the game lamp u1*a* is located.

In this way, when establishment of a big winning combination is determined, game sound effects for establishment of a big winning combination are emitted from the speaker p1*a* located close to the big win symbol 41*a* on the symbol reel 4, the reel still spinning. Simultaneously, attractive optical game effects for establishment of a big winning combination are emitted from the game lamp u1*a* located close to the big win symbol 41*a*. In association with movement of the big win symbol 41*a* of the symbol reel 4 which is not stopped and whose symbol to be stopped is not determined, sound effects for establishment of a big winning combination and optical effects for establishment of a big winning combination are emitted.

Concurrently, information about the symbols on the stationary symbol reels 2, 3, and 4 appearing at the respective stations s1, s2, s3, s4, . . . sn is transmitted from the CPU 11 to the display panels h1 . . . hn of the respective stations s1, s2, s3, s4, . . . sn by way of the image circuit 25.

Subsequently, occurrence of a win on the respective stations s1, s2, s3, s4, . . . ; namely, alignment, along the payout lines ht1 . . . on which individual players have bet coins or tokens beforehand, of symbols on the symbols reels 2, 3, and 4 which would constitute a winning combination, is determined by use of the win achievement symbol combination table stored in the ROM 12. Thus, payout information; that is, the number of winning players and the number of coins or tokens to be paid out, is determined.

Establishment of a winning combination is not necessarily set as a case where three symbols that constitute a winning combination are aligned.

The thus-determined payout information is transmitted from the CUP 11 to the hoppers by way of the output circuits 27 of the respective stations s1, s2, s3, s4, . . . sn. Coins or tokens corresponding to a reward for achievement of a win are paid to winning players and stored in the payout receivers m1, . . . mn.

The payout information is recorded on the RAM 13 or the hard disk drive 14 for respective stations s1, s2, s3, s4, . . . sn along with the bet information about the respective players.

When a bonus game is established as a result of combination of the symbols on the symbol reels 2, 3, 4 that are determined in an basic game, processing of a bonus game is performed.

Here, the bonus game is played in images appearing on the display panels 1*h* . . . of the respective stations s1, s2, s3, s4 . . . .

Image information about a bonus game is transmitted from the CPU 11 to the display panels 1*h* . . . of the respective stations s1, s2, s3, s4, . . . at which a bonus game is established, by way of the image circuit 25, whereby bonus game images are displayed.

Here, the image information about a bonus game corresponds to images showing spinning of the symbols 21 . . . on the symbol reel 2, spinning of the symbols 31 . . . on the symbol reel 3, and spinning of the symbols 41 . . . on the symbol reel 4. After lapse of a predetermined period of time counted by the timer, spinning actions of the symbol reels 2, 3, and 4 in the image are sequentially stopped, thereby determining a symbol on the symbol reel 2, that on the symbol reel 3, and that on the symbol reel 4. The thus-determined symbols appear on the display panels 1*h*.

Here, as in the case of an basic game, random numbers produced from the random number generator are used for random numbers to be used for determining the stop positions of the symbol reels 2, 3, 4 in the bonus game.

Subsequently, occurrence of a win is determined for the respective stations s1, s2, s3, s4, . . . where the bonus game is played, by use of the win achievement symbol combination table stored in the ROM 12. Thus, bonus payout information; that is, the number of winning players or the number of coins or tokens to be paid out, is determined.

The thus-determined bonus payout information is transmitted from the CPU 11 to the output circuit 27 of the stations s1, s2, s3, s4, . . . sn where the bonus games is played. Coins or tokens corresponding to a reward for achievement of a win are paid from the hoppers to winning players and stored in the payout receivers m1 . . . .

The bonus payout information is recorded on the RAM 13 or the hard disk drive 14 for respective stations s1, s2, s3, s4, . . . sn where bonus games is played.

When processing of the bonus game is completed, processing of an basic game is resumed.

Here, the game machine is constructed such that a bonus game is to be played in the form of an image by use of the display panels h1 . . . of the stations s1, s2, s3, s4 . . . where a bonus game is established. Needless to say, the bonus game can be performed by rotating actual symbol reels 2, 3, and 4.

There will now be described processing, such as storage/reference of game data pertaining to results of the basic games and those of the bonus games.

As mentioned previously, results of basic games and those of bonus games played on the respective stations s1, s2, s3, s4, . . . sn are recorded on the RAM 13 and the hard disk drive 14 along with bet information about the respective players.

When the game machine manager desires to refer to game result information, desired game results or data pertaining to game results are summated and displayed on the maintenance monitor 22 as various game result aggregates or statistic values for reference.

More specifically, when a request for displaying game results is sent to the CPU 11 by means of operation of the game machine manager, the CPU 11 reads game result information from the RAM 13 or the hard disk drive 14 and processes the information in accordance with the request by the game machine manager. The thus-processed information is transmitted to the maintenance monitor 22 as image information, by way of the image circuit 19.

The maintenance monitor 22 to which image information is transmitted from the CPU 11 displays a game result information image requested by the game machine manager.

The game machine manager displays, on the display panels h1 . . . of the arbitrary stations s1, s2, s3, s4, . . . sn, the game result information image to be displayed on the maintenance monitor 22.

When a player who plays games on the stations s1, s2, s3, s4, . . . sn desire to ascertain results of his/her games; for example, results of the games played in the past, a total number of inserted coins or tokens, and a total number of coins or tokens to be paid out, the player issues a request for displaying his/her game results by pressing a remaining credit ascertainment button of the control button section b1 on the operation table t1.

Then, a signal to be output from the button switch—which is to be turned on when the remaining credit ascertainment button of the control button section b1 is pressed—is transmitted to the CPU 11 by way of the input circuit 26.

Upon receipt of a request for displaying game results of a player, the CPU 11 reads game result information for each station from the RAM 13 or the hard disk drive 14 in accordance with the player's request and processes the thus-read game result information. The information is then transmitted to the display panel 1*h* as image information, by way of the image circuit 25.

The display panel h1 that is received the image information from the CPU 11 displays the game result information image requested by the player.

In this way, the players who play at the stations s1, s2, s3, s4, . . . sn can refer to desired game result information about their own games on the display panels h1.

Figure 10:
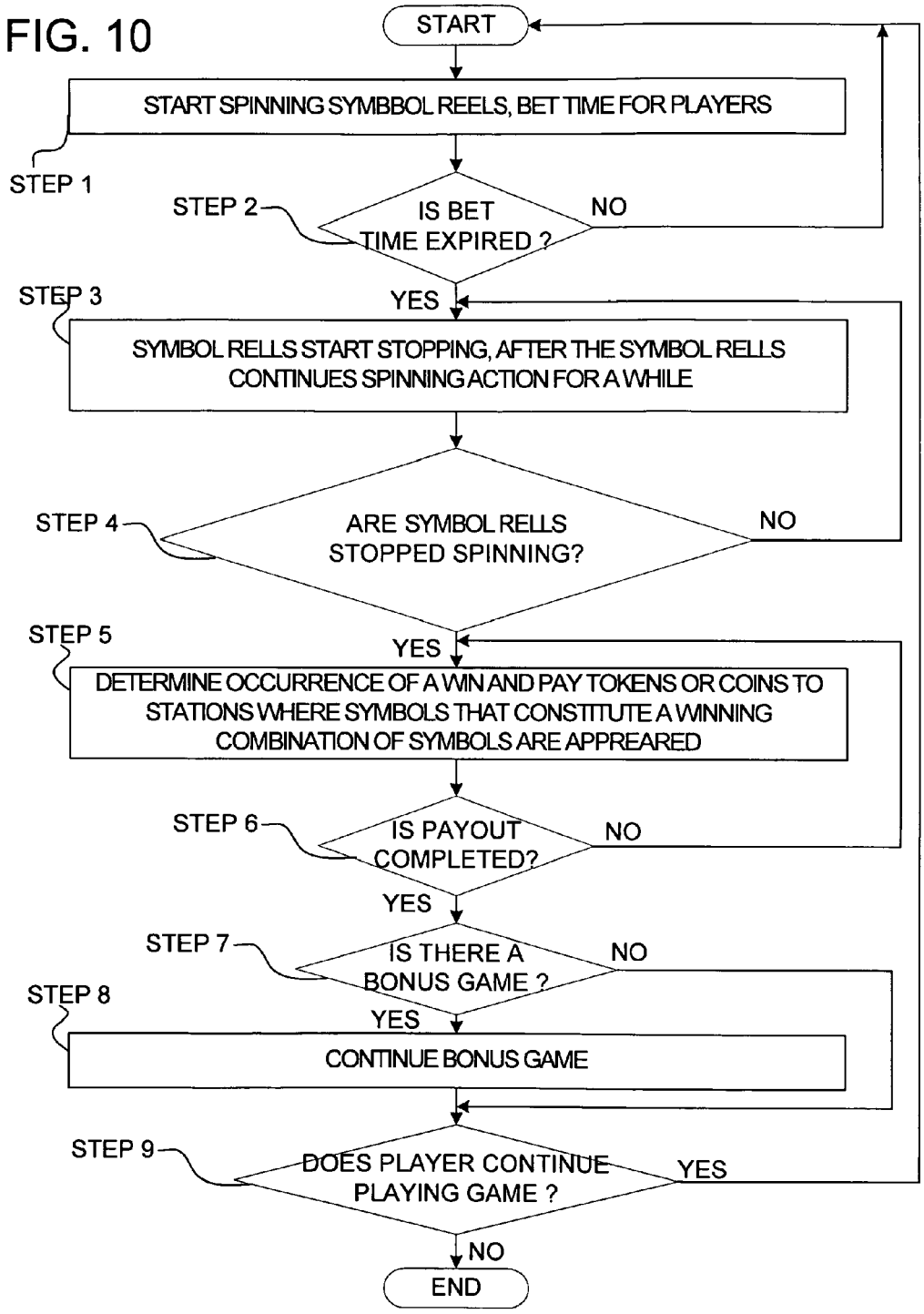
FIG. 10 is a flow chart showing the flow of a game to be played on a multi-station game machine of the embodiment.
Figure 11:
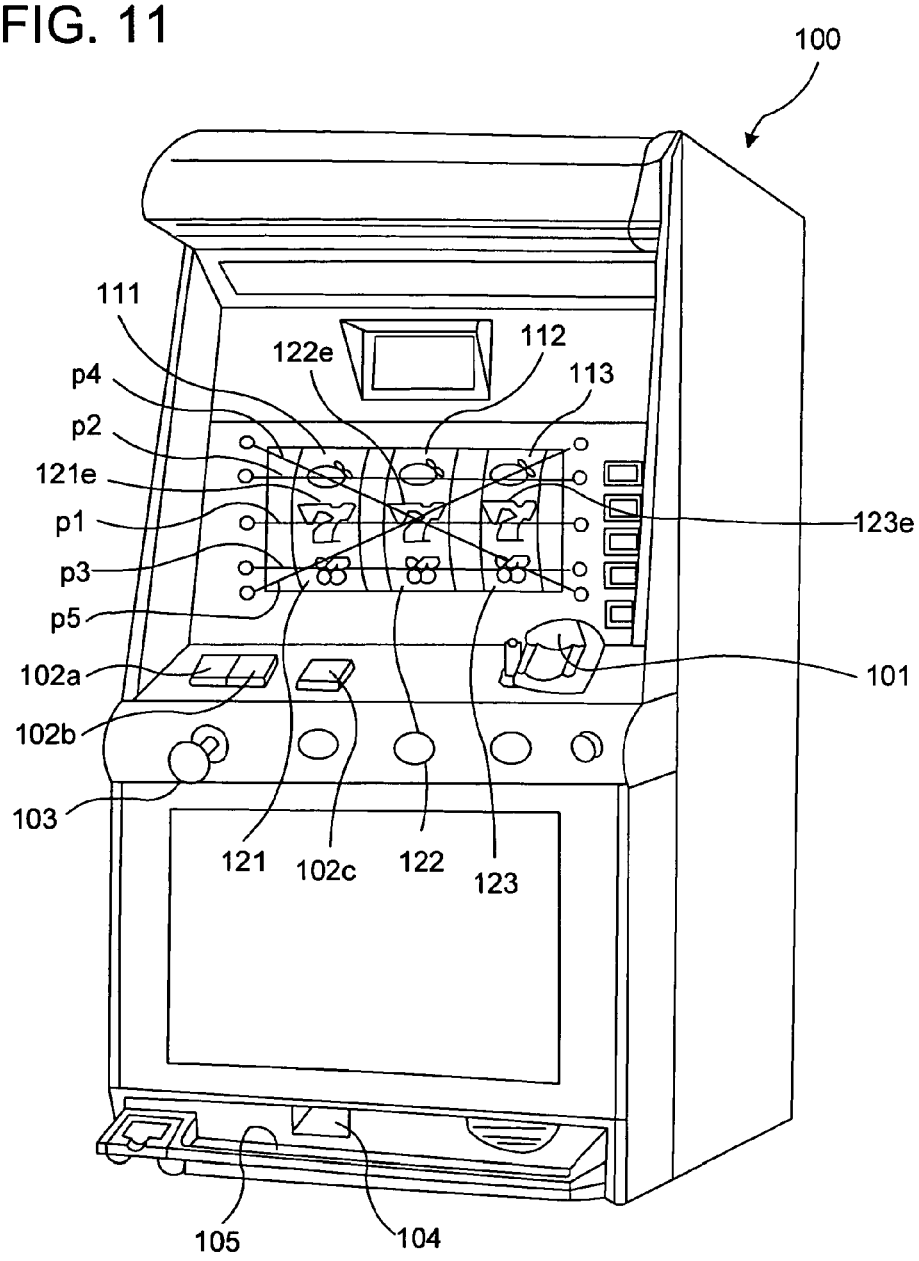
FIG. 11 is a perspective view showing a related game machine.

Next, the flow of a series of operations pertaining to a game to be played on the multi-station game machine 1 will be described by reference to FIG. 10.

When the game machine manager presses a game start button (not shown) of the multi-station game machine 1, (Step 1)

the symbol reels 2, 3, 4 start spinning.

The symbols 21 . . . on the spinning symbol reel 2, the symbols 31 . . . on the spinning symbol reel 3, and the symbols 41 . . . on the spinning symbol reel 4 concurrently appear on the display panels h1, . . . hn of the respective stations s1, s2, s3, s4, . . . sn. Further, a bet time information screen is displayed, thereby informing players of a bet time.

First, each of the players presses a line selection button of the control button section b1 on the bet time information screen, thereby selecting a desired payout lines ht11, ht12, ht13 . . . from the payout lines h11, ht12, ht13 . . . appearing on the bet time information screen.

Subsequently, each of the players presses the bet button or the maximum bet button of the control button section b1, thereby setting and displaying a desired number of coins or tokens inserted by the player beforehand and still reserved, and bets the coins or tokens on the selected payout lines ht11, ht12, ht13 . . .

(Step 2)

When the bet time is completed, completion of the bet time is displayed on the display panels h1 of the respective stations s1, s2, s3, s4, . . . sn, thus terminating the bet time information screen.

(Step 3)

After completion of the bet time, game sound effects are emitted from the speaker p1 in association with spinning of the symbols 21 . . . on the symbol reel 2, spinning of the symbols 31 . . . on the symbol reel 3, and spinning of the symbols 41 . . . on the symbol reel 4. Further, sound images are caused to go around the game machine. Alternatively, the following control operation may be performed, as required. Namely, optical game effects are emitted from the game lamp u1, and illumination light or blinking light is caused to go around the game machine.

After lapse of a predetermined period of time from the end of the bet time, spinning of the symbol reel 2, that of the symbol reel 3, and that of the symbol reel 4 are sequentially stopped.

Here, when establishment of a winning combination is determined through internal random selection, the following presentation is also performed, as required. Namely, game sound effects are emitted from the speaker p1 located close to the symbols on the spinning symbol reels 2, 3, 4, which symbols would constitute a winning combination. Sound images are caused to go around the game machine, and optical game effects are emitted from the game lamp u1 located close to the symbols. Further, illumination light or blinking light is caused to go around the game machine.

For instance, when a winning combination is determined by means of internal random selection, game sound effects are emitted from the speaker p1 located close to the symbols on any of the spinning symbol reels 2, 3, 4, that would constitute a winning combination. Sound images are caused to go around the game machine, and optical game effects are emitted from the game lamp u1 located close to the symbols. Further, illumination light or blinking light is caused to go around the game machine.

Alternatively, as shown in FIG. 8, when a big winning combination is determined through internal random selection, the big win symbol 21*a* on the symbol reel 2 is stopped and aligned with any one of the payout lines ht11, ht12, ht13 . . . . Subsequently, the big win symbol 31*a* on the symbol reel 3 is stopped and aligned with the same payout line. Game sound effects for establishment of a big winning combination are emitted from the speaker p1*a* located close to the big win symbol 41*a* on the symbol reel 4, which reel is still spinning. In addition, attractive optical game effects for establishment of a big winning combination are emitted from the game lamp u1*a* located close to the big win symbol 41*a*. In association with movement of the big win symbol 41*a*, sound effects for establishment of a big winning combination and optical effects for establishment of a big winning combination are emitted.

The foregoing presentation of a game can also be applied to establishment of a winning combination other than a big winning combination; e.g., establishment of a medium winning combination, establishment of a small winning combination, establishment of a bonus game, or establishment of a winning combination involving a payout higher than a predetermined payout.

(Step 4)

Are all the symbol reels 2, 3, and 4 stopped?

(Step 5)

Occurrence of a win is determined for each of the stations s1, s2, s3, s4, . . . . Coins or tokens are paid to the stations s1, s2, s3, s4, . . . where players are achieved a win. In other words, coins or tokens corresponding to a reward for a win are paid and stored in the payout receivers m1 . . . .

(Step 6)

Is payout processing completed?

(Step 7)

Does a result of determination of occurrence of a win for each of the stations s1, s2, s3, s4, . . . show any winners in the stations s1, s2, s3, s4 . . . sn where a bonus game is established?

(Step 8)

When a bonus game is established in the stations s1, s2, s3, s4, . . . sn, a bonus game image appears on the display panels 1*h* of the stations s1, s2, s3, s4, . . . where a bonus game is to be played.

The symbols 21 . . . on the symbol reel 2, the symbols 31 . . . on the symbol reel 3, and the symbols 41 . . . on the symbol reel 4 are stopped in the bonus game image after spinning of the symbol reels, as required, whereby symbols on the symbol reels 2, 3, and 4 are determined, to thereby display the symbols on the display panels 1*h*.

Occurrence of a win is determined. A bonus payout; that is, coins or tokens corresponding to a reward for a bonus win, is paid from hoppers to winning players and stored in their payout receivers m1 . . . .

(Step 9)

When the players continue playing games, processing returns to (Step 1).

As mentioned above, the flow of a series of operations pertaining to a game to be played on the multi-station game machine 1 is described. As bonus games which are to be displayed and played on the display panels 1*h* of the stations s1, s2, s3, s4, . . . sn, games other than the combination game, such as card games or bingo games, may be employed.

In the embodiment, a combination game involving usage of the symbol reels 2, 3, 4 is performed first, and a bonus game is offered to solely the players who are awarded the right to play a bonus game, by way of the display panels 1*h*. Conversely, all players may individually play bonus game by way of the display panels 1*h* prior to a combination game involving usage of the symbol reels 2, 3, and 4. In the bonus game, only the players who are gained certain points are awarded the right to play a combination game involving usage of the symbol reels 2, 3, 4.

Various games can be realized by combination of the combination games involving usage of the symbol reels 2, 3, 4 and a bonus game appearing on the display panels 1*h*.

In the above configuration, players can play games at the stations s2, s3, s4, . . . disposed so as to surround the multi-station game machine 1. Hence, a plurality of players can enjoy playing games simultaneously.

As can be seen from FIGS. 2 through 7, all symbols on the symbol reels 2, 3, and 4 can be utilized for the games. Hence, payout lines can be produced for all symbols on the symbol reels 2, 3, and 4.

In addition, during the course of a game, speakers disposed around the symbol reels 2, 3, and 4 sequentially emit sound or become muted, and/or game lamps are sequentially illuminated and extinguished. Hence, attractive presentation of a game becomes possible.

Game sound effects are emitted from the speaker p1 in association with spinning of the symbols 21 . . . on the symbol reel 2, spinning of the symbols 31 . . . on the symbol reel 3, and spinning of the symbols 41 . . . on the symbol reel 4. Further, sound images are caused to go around the game machine; optical game effects are emitted from the game lamp u1; and illumination light or blinking light is caused to go around the game machine, thereby enabling presentation of a game which provides audiovisual stimulation.

When establishment of a winning combination is determined by symbols, or as a result of combination of symbols through internal random selection, game sound effects are emitted from the speaker located close to the symbols which are to constitute a winning combination and provided on any of the symbol reels, the reels being currently spinning and to stop; sound images are caused to go around the game machine; optical game effects are emitted from the game lamp u1 located close to the symbols that are to constitute a winning combination; and illumination light or blinking light is caused to go around the game machine, thereby augmenting interest in games.

Alternatively, establishment of a big winning combination is assumed to be determined by symbols or as a result of combination of symbols through internal random selection. Symbols that would constitute a winning combination are assumed to be stopped and aligned with a payout line. A symbol reel which is not stopped and whose symbol to be stopped is not determined is assumed to still be spinning. Only under these circumstances, if game sound effects are emitted from the speaker p1*a* located at a position corresponding to the symbols and optical game effects are emitted from the game lamp u1*a* located at a position corresponding to the symbols, sound images and illumination light or blinking light are caused to go around the game machine in association with spinning of the final symbol which is not determined to be stopped and would constitute a winning combination. Hence, the interest of the player who hopes for establishment of a winning combination is augmented more and more, thereby achieving a rich entertainment characteristic.

The reference payout lines are provided to respective players of stations, thereby making the stations explicit and easy to determine. Players can play games while clearly ascertaining their own stations.

Shared payout lines to be shared between adjacent players are provided on the game machine. Hence, when a winning combination is established along any of the shared payout lines, coins or tokens are excessively paid to adjacent players as a celebratory payout and a shared bonus payout, which are not provided by related game machines, thereby enabling a winning player to share the pleasure of winning with the adjacent players.

In this way, shared payout lines enable realization of additional payouts which are not available on the related game machines. Hence, a great merit for players is realized; that is, an increased chance of profitably betting coins or tokens on payout lines. Further, because of a demerit, which would otherwise be yielded when the player does not bet any coins or tokens on a shared payout line; that is, the impossibility of gaining a large amount of payout without betting coins or tokens on the shared payout lines, a player is motivated to bet coins or tokens on as many payout lines as possible in order to avoid experiencing regret or to achieve a win in a game. Hence, players can fully enjoy the pleasure of games, a feature which is not offered by related game machines.

In addition, players who achieves a win in the bonus game through a combination game involving usage of the symbol reels 2, 3, 4 can play bonus games by way of display panels after completion of the combination games.

Bonus games to be played over images appearing on the display panels can also be provided prior to a combination game involving usage of the symbol reels 2, 3, 4. By means of causing a combination game involving usage of the symbol reels 2, 3, 4 to be associated with a bonus game involving images appearing on display panels, a variety of games can be realized.

Accordingly, a plurality of players can enjoy playing games simultaneously. Further, players can share payout lines, thereby realizing additional payouts. Thus, there is realized a multi-station game machine which enables augmentation of interest in games and is rich in entertainment characteristic.

In the embodiment, symbol reels are constructed in three layers. However, the number of symbol reels can be arbitrarily set to two layers, four layers, five layers, or any other number of layers, as required.

Although the symbol reels are constructed so as to spin individually and horizontally around a vertical axis, needless to say, symbol reels can be constructed so as to be able to individually and substantially horizontally spin around a substantially vertical axis.

Second Embodiment

Another embodiment of a multi-station game machine according to the present invention will be described hereinafter by referencing to the drawings.

First, the configuration of the multi-station game machine for a wheel game will be described. A wheel game on the multi-station game machine will be described thereinafter by using a roulette game as an example of the wheel game.

Figure 12:
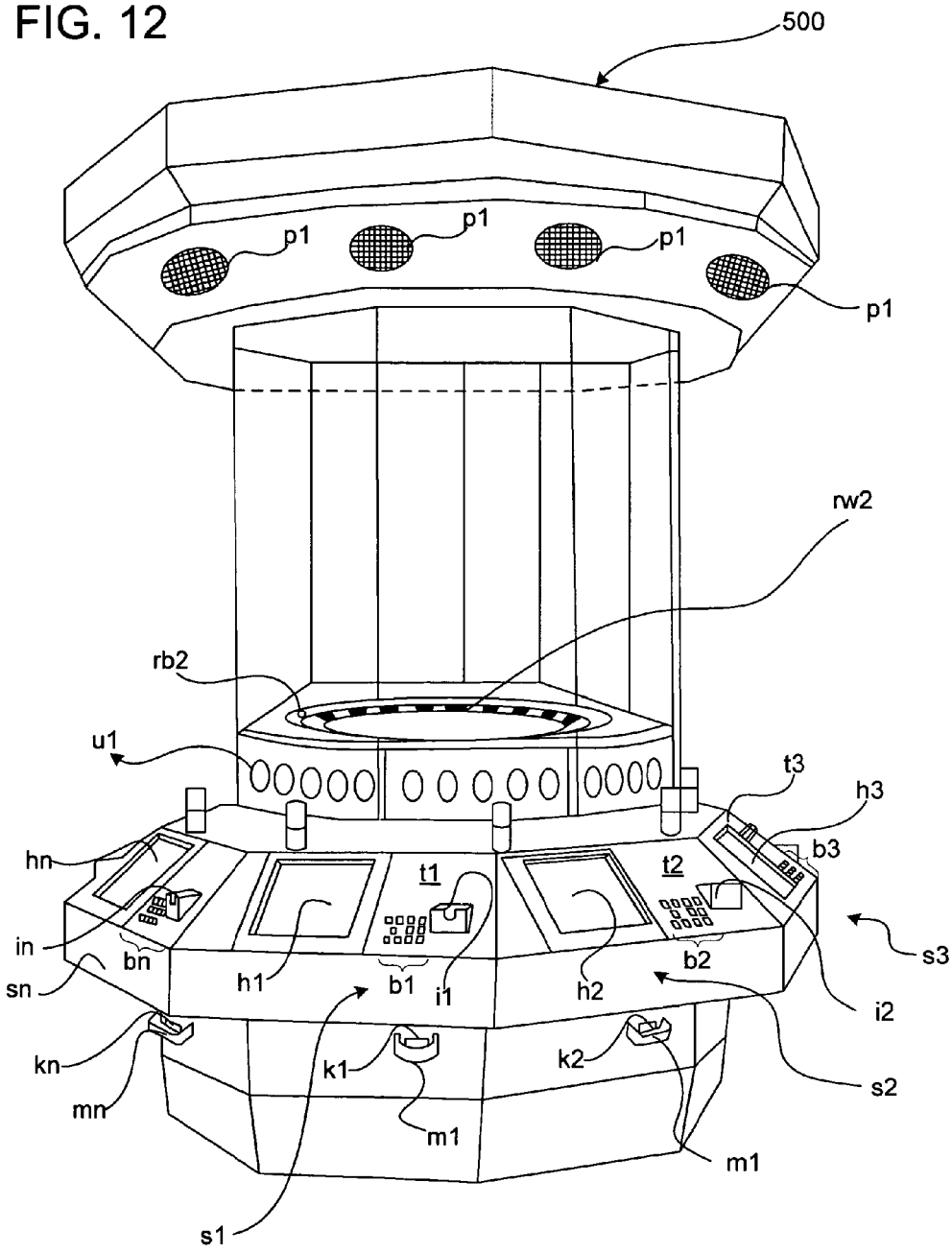
FIG. 12 illustrates a perspective view showing a multi-station game machine according to another embodiment of the invention.

FIG. 12 illustrates a perspective view showing a multi-station game machine 500 with which a plurality of players enjoy playing a wheel game (a first game or a primary game) by using the any of stations s1, s2, s3, s4, . . . sn. The multi-station game machine 500 is configured the same as the multi-station game machine 1 illustrated in FIG. 1.

The stations s1, s2, s3, . . . sn illustrated in FIG. 12 have basically the same configuration as the stations s1, s2, s3, . . . sn illustrated in FIG. 1 except for the symbol reels 2, 3 and 4 for the combination games and their related control electronics. The multi-station game machine 500 is equipped with a wheel rw2 and a ball rb2 (it may be a mark on a display, which will be described later), which rotates around the circumference of the wheel rw2.

The section having the same number and character as that of the section in FIG. 1 has the same function. In order to avoid duplicated explanation, only the portions, which need to be explained, will be described hereinafter.

Figure 13:
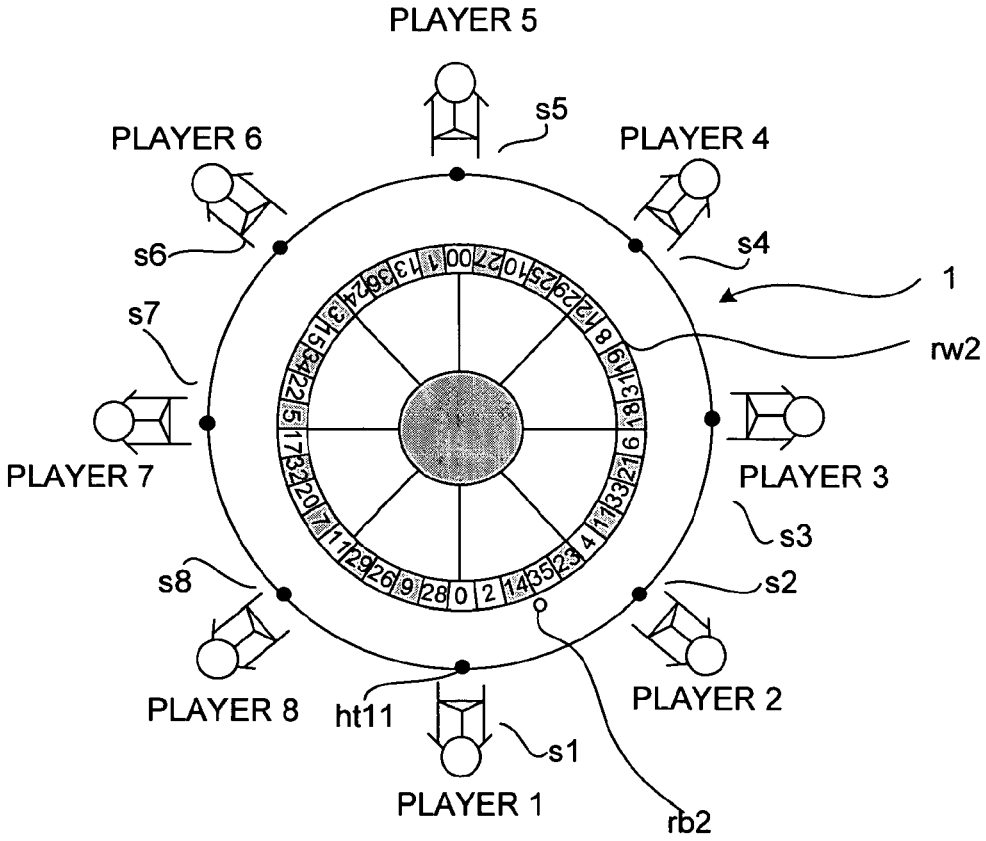
FIG. 13 illustrates a conceptual plan view showing the layout of players when the multi-station game machine of a wheel game has eight stations.

FIG. 13 illustrates a conceptual plan view showing the layout of players when the multi-station game machine of a wheel game has eight stations. The wheel rw2 is a large round wheel on which a plurality of sections having symbols including numbers of 0, 00, 1, 2, . . . 36 colored in red or black is arranged along the circumference of the shape of the wheel. The wheel rw2 is configured to spin in one direction. The ball rb2 is arranged to rotate in the other direction around the circumference of the wheel rw2.

Figure 14:
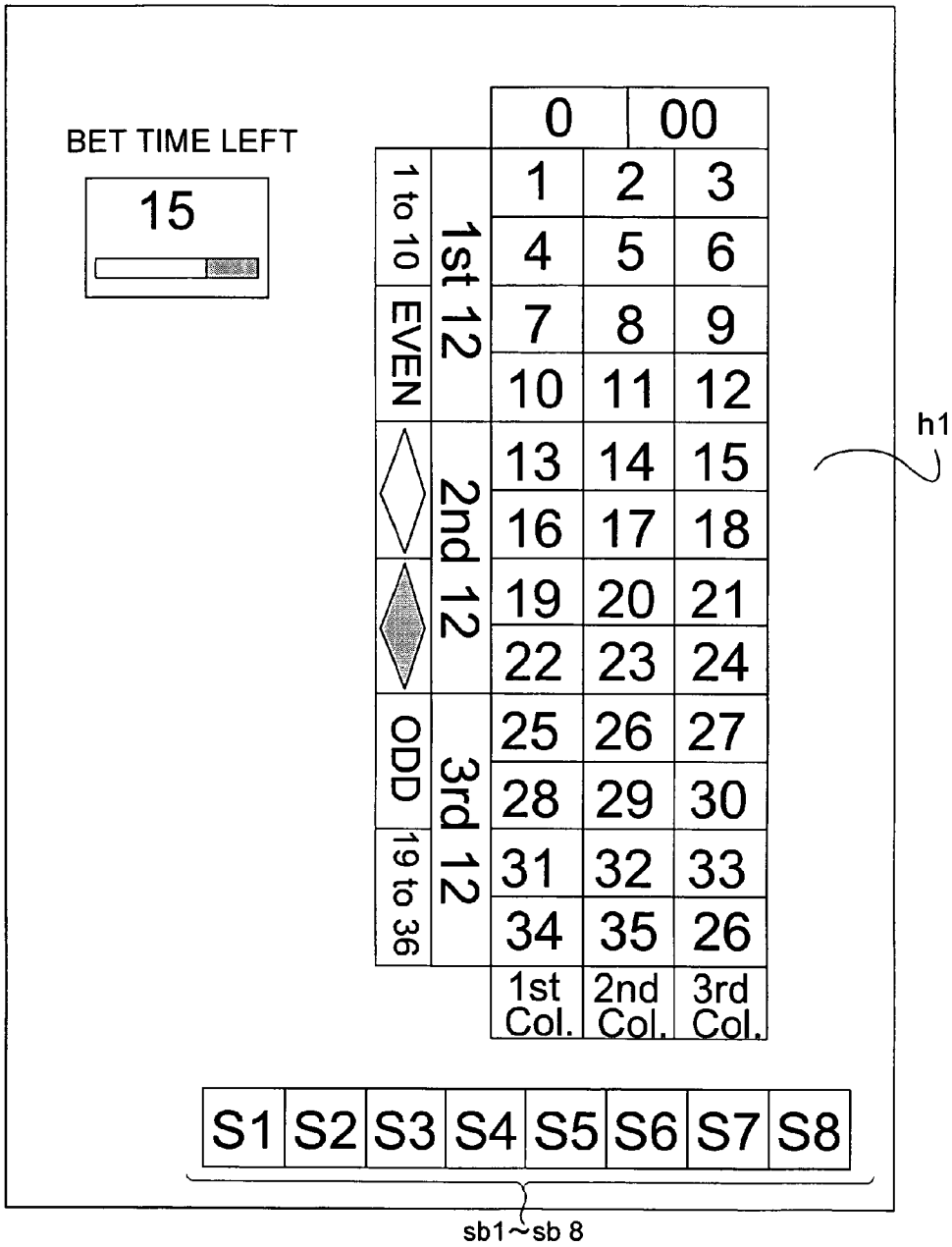
FIG. 14 illustrates a screen of a bet area of a wheel game displayed on the display.

With regard to bet areas, as shown in FIG. 14, the bet area, which will be displayed on the displays h1, h2 . . . hn on stations s1, s2 . . . sn includes an inside bet area having numbers 1-36, 0 and 00, and an outside bet area having odd/even, RED/BLACK, 1-18, 19-36.

A roulette game is a popular game in casino floor in which players place bets on either a number, an odd or even number, a range of numbers, or the color red or black. In determining the winning number and color, a wheel spins in one direction, then a ball is spun so that it evolves in the other direction around the circumference of the wheel. The ball gradually slows down losing its momentum and lands into one of 38 pockets on the wheel.

The wheel rw2 spins in one direction while the ball rb2 rotates around the circumference of the wheel rw2 in the other direction. While the wheel rw2 and the ball rb2 are rotating, the player selects the desired bet area displayed on the displays (h1, h2, . . . hn) provided on the operating tables (t1, t2, . . . tn) of the stations (any of s1, s2, . . . sn) occupied by the players, and bets a game value that is previously inserted (e.g., tokens, coins, paper currency, or some form of credit indicator, such as a credit card) on the selected bet area.

FIG. 14 illustrates a screen of the bet area of a wheel game displayed on the display h1. As shown in FIG. 14, the bet area is configured by numbers from 0, 00, 1, 2-36, $1^{st}$ col.-$3^{rd}$ col., which are called a inside bed area, and by $1^{st}$ 12, $2^{nd}$ 12, $3^{rd}$ 12, 1-18, 19-36, even, odd, RED and BLACK, which are called an outside bet area. In general, in case when a player hits a win in the inside bet area, the reward is high. In case when the player hits a win in the outside bet area, the reward is relatively lower than the reward of the inside bet area.

In this embodiment, the player can bet on the bet areas by selecting any section of the bet areas by touching touch panel switches provided on the respective displays h1, h2, . . . hn. With regard to the bet amount, which a player can bet, the player can place a bet amount on any bet area by using control buttons b1, b2, . . . bn on the operating tables t1, t2, . . . tn.

After the players bet on the bet area, the wheel rw2 and the ball rb2 sequentially stops after rotating for a while. Then, the ball rb2 falls into any one of the numbers on the wheel rw2 and a winning number is determined. When a winning bet area is determined from the winning number, a payout amount that is predetermined from the bet amount is paid to the players who betted on the winning bet area.

In this embodiment, the ball is used with the wheel. However, the ball may be a mark displayed on a display provided around the wheel and which is arranged to rotate around the circumference of the wheel.

Next, a celebratory payout and a shared bet area on the wheel game will be described using the multi-station game machine 500 illustrated in FIG. 12.

FIG. 14 shows shared buttons sb1-sb8 on the display h1. These shared buttons sb1-sb8 allow a player on any one of the stations on the multi-station game machine 500 to share any bet area with any stations on the multi-station game machine 500. For example, the player occupying the station S1 is assumed to have betted on "29" in the inside bet area and touches a shared button sb5 before the end of bet time. By touching the shared button sb5, the player on the station S1 can share the bet area "29" with the station S5 as a shared bet area.

The shared bet area can be specified by a player touching any one of the shared buttons sb1-sb8 on the displays h1-*hn*. When the player presses any of the shared buttons sb1-sb8, the shared bet area is established between the player and the station correlated with the shared buttons sb1-sb8.

A celebratory payout and a shared bonus payout are set as payouts to be provided when a win is achieved at any of the shared bet areas.

In the case of a conventional roulette game, when a win is achieved as a result of the game, nothing is paid to the player who did not bet.

In contrast, in the multi-station game machine 500, in case when a win is achieved on the shared bet area as a result of the game, a player who betted on the winning shared bet area is rewarded a payout for betting on the winning shared bet area, and the station that was selected by the player to share the bet area with, but did not bet on the shared bet area is also rewarded with the payout from the winning shared bet area as a celebratory payout.

For example, as shown in FIG. 13, a player 1 playing at the station s1 is assumed not to have betted on a bet area "33" before end of bet time and a player 2 playing at the station S2 is assumed to have betted on the bet area "33" before end of bet time and to have touched a shared button sb1 on the display h1 in FIG. 14 to share the bet area "33" with the station s1 as a shared bet area. When the bet area "33" becomes a winning bet area as a result of the wheel game, the player 2 is rewarded a payout for betting on the bet area "33," which became a winning bet area. Further, although the player 1 did not bet on the bet area "33" that became the winning bet area, the player 1 is rewarded the payout as a celebratory payout for the player 2 shared the bet area "33" with the player 1 by touching the shared button sb1 before end of bet time.

In this case, the shared bet area that the celebratory payout was provided was the bet area "33." However, any other shared bet area may be provided with the celebratory payout.

Next, a shared bonus payout will be described. In this example situation, a player bets on a shared bet area before the end of bet time, and another player also bets on the same shared bet area before the end of bet time. When both players bet on the same shared bet area and a win is achieved on the shared bet area on which the players bet, a payout is rewarded to both players who betted on the winning shared bet area for achievement of a win as a result of the game. In addition, a bonus payout is also paid to both players as a shared bonus payout.

For example, in FIG. 13, the player 1 playing at the station s1 is assumed to have betted on a bet area "35" before the end of bet time, and a player 8 playing as the station s8 is also assumed to have betted on the bet area "35" before the end of bet time. Then, when both the player 1 and the player 8 touch the shared button sb8 and sb1 respectively, the bet area "35" is shared between the player 1 and the player 8 as the shared bet area. In case when the bet area "35" becomes a winning bet area as a result of the game, both the player 1 and the player 8 are rewarded a payout for betting on the bet area "35", which is the winning bet area. In addition, the player 1 and the player 8 are rewarded a shared bonus payout, which is paid out as a bonus payout.

The shared bonus payout was provided to the players who have selected the bet area "35" in this case. However, the bet area may not be the bet area "35" and may be any other bet areas.

As mentioned above, the celebratory payout and the shared bonus payout paid to the player 1 are described as examples of when a win is established along a shared bet area. Needless to say, under similar conditions, the celebratory payout and the bonus payout are paid to the other players in the same manner. In the above embodiment, a roulette game is described as an example to the wheel game. However, a large wheel game having a fixed mark instead of a ball rotating around the wheel is also applicable to the wheel game of the multi-station game machine.

In the embodiment, the wheel rw2 and the ball rb2 are constituted of mechanical structures. Here, the symbols including numbers 0, 00, 1, 2 . . . 36 and the ball may be constituted of marks or symbols of images on a display device such as an LCD (liquid-crystal display), a CRT (cathode-ray tube), or a DLP (digital light processing) projector using an image display device DMD (digital micro-mirror device).

As shown in FIG. 12, in the multi-station game machine 500, a plurality of speakers p1 and a plurality of game lamps u1 are provided around the wheel rw2. In association with rotations of the wheel rw2 and/or the ball rb2, game sound effects are emitted from the speakers p1; sound images revolves around the game machine; optical game effects are emitted from the game lamps u1; and illumination or blinking of light revolves around the game machine, to thereby enable presentation of a game to be provided with audiovisual stimulation.

An explanation will be now given to the revolving of sound images and the revolving of illumination or blinking of light. When a bet time ends, game sound effects are emitted from the speakers p1; sound images revolve around the game machine along with the movement of the ball rb2; optical game effects are emitted from the game lamps u1; and illumination or blinking of light revolve around the game machine so that the movement of the ball rb2 is identified by the direct view of the ball rb2, the illumination or blinking of light associated with the movement of the ball rb2 and revolving of the sound image of the ball rb2 correlated to the wheel rw2, as an advance notice of establishment of a winning combination. The illumination or blinking of light may be started when the ball rb2 starts moving.

As the rotation speeds of the wheel rw2 and the ball rb2 slow down, and the numbers that the ball rb2 is passing through become more visible, the expectation of win become large and more interest can be drawn to the wheel game by using optical and sound effects described above.

When the bet time ends, and while the wheel rw2 and the ball rb2 are under rotation, the moving location of the ball rb2 aligns the all bet areas, (which correspond to a big win or a big reward bet area) onto which players have bet, the speaker P1 located close to the stations which have bet the bet area emits game sound effects.

For example, in case when the player playing at the station S1 bets on the bet area "28", and when the ball rb2 and the number "28" on the wheel rw2 aligns as the wheel rw2 and the ball rb2 are in motion, game sound is emitted from the speaker p1 located close to the station S1. At the same time, the lamps u1 on the station 1 may emit or blink lights. The sound images are arranged to move around the wheel rw2 toward the next alignment of the bet areas and ball rb2 on the wheel rw2.

Sound images and optical effects for establishment of a big winning move around the game machine in association with the spinning action of the wheel rw2 and the ball rb2. In this way, the interest of the player who is expected to benefit from the big winning is enhanced more and more.

In the example, when a winning bet area is determined by the game, sound effects of the winning are emitted from the speakers P1 located close to the stations that have betted on the winning bet area. Attractive optical effects of the winning are emitted from the game lamp u1 located close to the stations that have won the game. In this embodiment, the multi-station game machine is designed to emit the sound effect and/or the optical effects when relatively big win occurs. Needless to say, the foregoing configuration can also be applied to establishment of a win other than a big win; e.g., establishment of a medium win, establishment of a small win, establishment of a bonus game (i.e., a second game), or establishment of a win involving a payout higher than a predetermined payout.

With regard to the presentation of the game sound effects and optical game effects, effects to be emitted may not be limited to only game sound effects or only optical game effects. Alternatively, both the game sound effects and the optical game effects may be emitted in conjunction with each other.

Control configuration of the multi-station game machine 500 will now be described by using FIG. 15.

Figure 15:
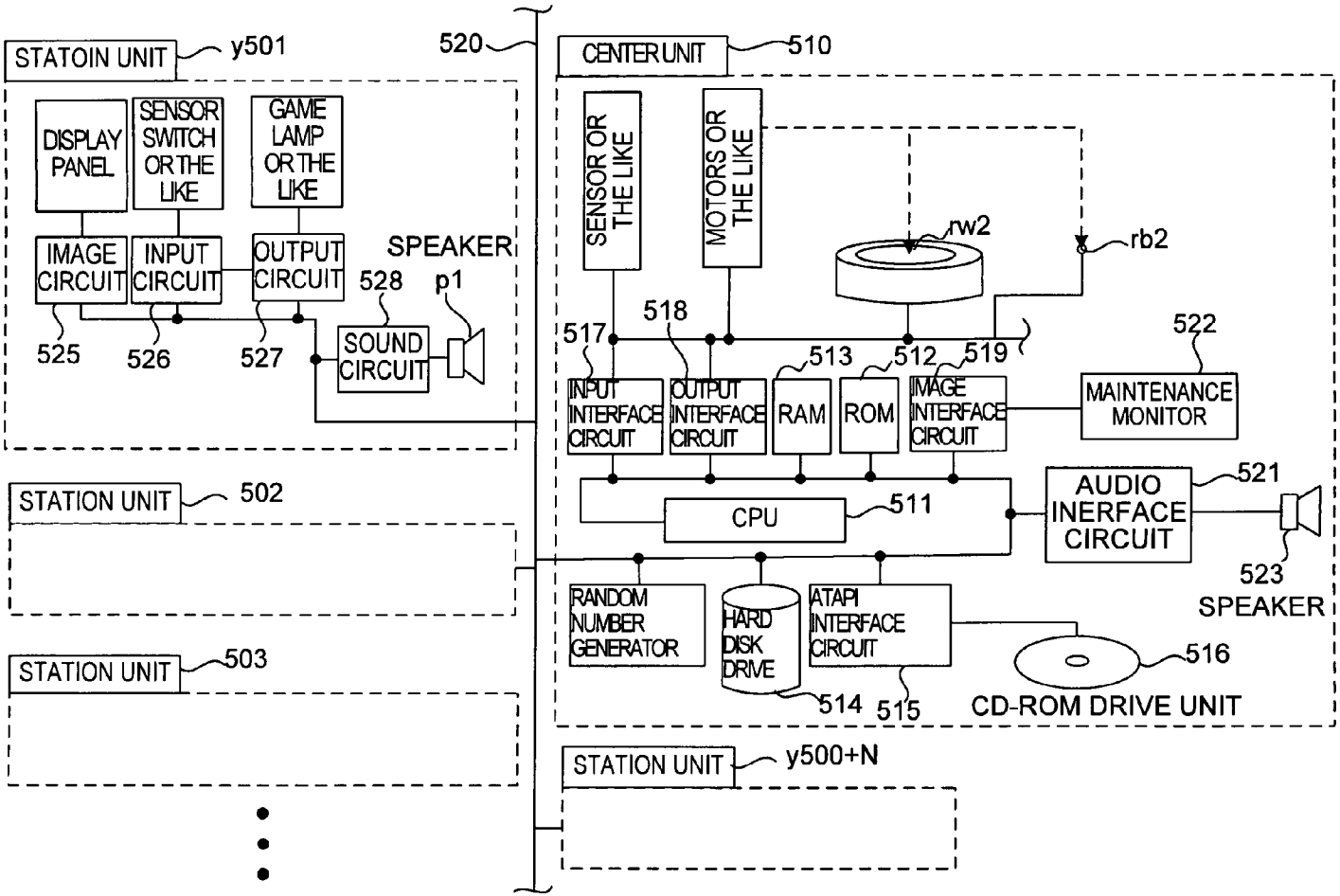
FIG. 15 illustrates a block diagram showing a control configuration of a multi-station game machine of the wheel game described as another embodiment of the present invention.

FIG. 15 illustrates a block diagram showing a control configuration of a multi-station game machine of a wheel game described as another embodiment of the present invention.

Control of the multi-station game machine 500 is configured such that a center unit 510 for controlling the overall game machine in accordance with a stored control program is connected with station units y501, y502, . . . , y500+n which are disposed so as to correspond to the respective stations s1, s2, . . . sn and control sections of the respective stations s1, s2, . . . sn, the control sections for exchanging control signals with the center unit 510, transmitting output data, and receiving input data, by way of a system bus 520 of 16-bit or 32-bit width.

The station units y501, y502, . . . , y500+n are of identical configuration.

The center unit 510 is configured by a CPU (central processing unit) (also called a game speaker controller and a game lamp controller) 511 that serves as a central processing unit, ROM (read-only memory) 512 that is non-volatile memory, RAM (random-access memory) 513 that is volatile memory, a hard disk drive 514 having a large storage capacity, an ATAPI (advanced technology attachment packet interface) interface circuit 515 and interface circuits 517, 518, 519, 521, which are all connected via the system bus 520. The center unit 510 is also configured by a CD-ROM drive 516, which is connected to the center unit 510 via the ATAPI (advanced technology attachment packet interface) interface circuit 515.

The ROM 512 has control data or a table to be used for controlling rotation and stoppage of the wheel rw2 and the ball rb2 through use of a timer (not shown).

The table stored in the ROM 512 includes, e.g., a table for controlling stoppage of the wheel rw2 and the ball rb2; a speaker position table; and a game lamp position table.

Here, establishment of a win established by the stoppage of the wheel rw2 and the ball rb2 is determined by use of random numbers generated from predetermined probabilities by a random number generator consisting of a hardware counter. The random number generator may be constituted by use of software.

Stored in a win table is data pertaining to the amount of reward to be supplied to a player in accordance with establishment of various wins.

The speaker position table is a table on which positions of the speakers P1 of the multi-station game machine 500 are recorded.

The game lamp position table is a table on which positions of the game lamps u1 of the multi-station game machine 500 are recorded.

A control program to be used for controlling the overall multi-station game machine 500 is recorded on the ROM 512. The control program is used for controlling stop positions of the stepping motors, the motor being used for spinning the wheel rw2 and the ball rw2; controlling hoppers to be used for paying out rewards; performing processing for betting on any of the bet areas; ascertaining the number of remaining credits; ascertaining game results; operation control for illuminating or blinking the game lamps u1; and control for outputting sound from the speakers p1.

A work area to be used for executing the control program is generated in the RAM 513, or variable data are temporarily stored in the RAM 513.

More specifically, stored in the RAM 513 are data pertaining to the number of credits inserted into and paid out of the respective stations s1, s2, s3, . . . sn, and a total number of credits inserted into and paid out from the respective stations.

By means of executing the program stored in the ROM 512, the CPU 511 controls the respective stepping motors to be used for spinning the wheel rw2 and the ball rb2 and the overall multi-station game machine 500, such as various processing operations corresponding to input operations of players.

Stored in the hard disk drive 514 are data pertaining to results of games played at the respective stations and a history of game results.

The CD-ROM drive 516 is used for loading CD-ROMs having image data or the like recorded thereon onto displays of the respective stations s1, s2, s3, . . . sn, or for loading CD-ROMs having a control program of updated version stored therein at the time of installation of the control program of updated version.

An input interface circuit 517 functions as an input interface for inputs from position sensors or for sensing positions of the wheel rw2 and the ball rb2, and an output interface circuit 518 functions as an output interface for outputs, such as control signals from the CPU 511 to the stepping motors of the wheel rw2 and the ball rb2.

A maintenance monitor 522 is a monitor to be used by a game machine manager for performing maintenance on the multi-station game machine 500. A display section of the maintenance monitor 522 is constituted of a CRT or an LCD.

An image interface circuit 519 functions as an output interface for outputting an image signal from the CPU 511. The image interface circuit 519 outputs the image signal inputted from the CPU 511 to the maintenance monitor 522 by means of expansion and digital-to-analog conversion of the image data.

An audio interface circuit 521 is an output interface for outputting an audio signal outputted from the CPU 511 to a speaker 523 as an audio signal decoding the audio signal.

As mentioned above, the station units y501, y502, . . . y500+n are of identical configuration, and hence an explanation is now given of only the station unit y501.

The station unit y501 plays the role of an output interface for outputting an image signal outputted from the CPU 511 to the display h1, which displays progress in a game and a player's operation.

An image circuit 525 outputs the image signal transmitted from the CPU 511 to the display h1 as image information by means of expansion and digital-to-analog conversion of the image signal.

An input circuit 526 provided in the station unit y501 is an input interface for inputting a signal outputted from a sensor, such as a coin sensor (not shown) for sensing coins or tokens inserted via a coin insert slot, or a signal output from a switch, such as a button switch to be turned on when a button of a control button section b1 is pressed, into the CPU 511.

An output circuit (game lamp controller) 527 disposed in the station unit y501 is an output interface for outputting the signal delivered from the CPU 511 to the game lamps u1, which emit optical game effects, or to a hopper or the like which pays reward, and is constituted of an amplifying circuit or the like.

A sound circuit (game speaker controller) 528 disposed at the station unit y501 is an output interface for outputting an audio signal, which is delivered from the CPU 511, to the speaker p1 as an audio signal through decoding.

Next, control processing of the multi-station game machine 500 will be described.

Here, the control processing of the multi-station game machine 500 is performed by executing the control program recorded on the ROM 512.

Game modes of the multi-station game machine 500 are generally divided into a game executed when power is turned on, a normal game and a bonus game.

When power of the multi-station game machine 500 is turned on, systems installed in the center unit, such as the ROM 512, the RAM 513, and the hard disk drive 514, are inspected.

Next, the control program loads image data from the CD-ROM loaded in the CD-ROM drive 516 and transmits the image data to the respective image circuits 525 of the station units y501, y502, y503, y504, . . . via the system bus 520.

The respective image circuits 525 of the station units y501, y502, y503, y504, which outputs image information, which is received image data to the respective displays h1, h2 . . . hn, where by a game image appears on each of the displays h1, h2, . . . hn.

When a normal game is started, a control program is executed, whereupon a wheel drive signal and a ball drive signals are transmitted to the stepping motors for rotating the wheel rw2 and the ball rb2 from the CPU 511 via the output circuit 518, to thereby start spinning of the wheel rw2 and the ball rb2.

Information about positions of the wheel rw2 and the ball rb2 is transmitted to the respective image circuits 525 of the station units y501, y502, y503, y504, . . . , and the image circuits 525 for output image information to the respective displays h1, h2 . . . hn.

The displays h1 . . . into which the image information is inputted display the wheel rw2 and the ball rb2.

Concurrently, bet time information is transmitted to the respective image circuits 525 of the stations units y501, y502, y503, y504, . . . from the CPU 511. A bet time information screen including bet areas as shown in FIG. 14 appears on the respective displays h1, . . . of the stations s1, s2, s3, s4, . . . sn, thereby informing respective players of a bet time.

On the bet time information screen including bet area, each of the players bets a desired amount inserted for each of the desired bet areas.

More specifically, each of the players selects desired bet areas appearing on the bet time information screen by touching touch panel button provided on the displays h1, h2 . . . hn. The player may press a bet button or maximum bet button of the control button section b1, thereby display a desired number of credits from among the credits inserted on the bet time information screen and then bets the desired number of coins or tokens.

A bet area selection input signal output from the touch panel on the displays h1, h2, . . . hn and a number-of-bets set input signal outputted from the bet button or a button switch for the maximum bet button are transmitted to the CPU 511 as bet setting input signals via the input circuit 526.

Upon receiving the bet setting input signals for the respective stations s1, s2, s3, s4, . . . sn, the CPU 511 records the signals as bet information in the RAM 513 or the hard disk drive 14 for respective stations s1, s2, s3, s4, . . . sn.

Needless to say, the maximum number of coins or tokens to be betted, which is set by the maximum bet button, can be arbitrarily set; for example, to 10 and 12.

When a predetermined period of bet time counted by the timer is ended, the CPU 511 transmits bet time end information to the displays h1, h2, . . . hn of the respective stations s1, s2, s3, s4, . . . sn, and the information appears on the displays h1, h2, . . . hn, whereupon the bet time information screen is terminated.

As a result, only the wheel rw2 and the ball rb2 appear in a full screen on the displays h1, h2, . . . hn.

Concurrently, the following control operation is performed, as required. Namely, the CPU 511 sequentially transmits an audio signal to the speakers p1 . . . via a sound circuit 528. In accordance with spinning actions of the wheel rw2 and the ball rb2, game sound effects are emitted from the speakers p1, and sound images revolve around the game machine. The CPU 511 identifies the speakers and the lamps from which sound effects and optical effects are emitted when the moving location of the ball rb2 aligns the bet areas, onto which players have bet, along with the rotation of the ball rb2, and the speaker P1 located close to the stations which have betted on the bet area emits game sound. Then, at the time when this alignment occurs, the CPU 511 controls those speakers and lamps close to the station from which the bet areas have been betted so as to emit sound effects and optical effects as described previously.

After a predetermined period of time counted by the timer from the end of the bet time lapses, spinning actions of the wheel rw2 and the ball rb2 are sequentially stopped by use of the timer.

Subsequently, occurrence of a win on the respective stations s1, s2, s3, s4, . . . ; namely, along the bet areas on which respective players betted beforehand, winning stations are determined by use of the table having a win, which is stored in the ROM 12. Thus, payout information; that is, the number of winning players and the number of credits to be paid out, is determined.

When establishment of a big winning is determined by the CPU 511, sound effects for establishment of a big winning are emitted from the speakers P1 located close to the big winning stations by the control of the CPU 511. Attractive optical effects for establishment of a big winning are also emitted from the game lamps u1 located close to the big win stations.

The determined payout information is transmitted from the CPU 511 to the hoppers via the output circuits 527 of the respective stations s1, s2, s3, s4, . . . sn. Credits corresponding to a reward for achievement of a win are paid to winning players and stored in the payout receivers m1, . . . mn.

The payout information is recorded on the RAM 13 or the hard disk drive 514 for respective stations s1, s2, s3, s4, . . . sn along with the bet information about the respective players.

When a bonus game is established as a result of the winning of shared bet areas that are determined in a basic game or a primary game, processing of a bonus game is performed. In this embodiment, the primary game triggers the bonus game (secondary game) to the player who has won any one of numbers from 0, 00, 1-36. However it is not limited to these wins. For example, the primary game may triggers the bonus game to the player who has won any one of numbers from 0, 00, 1-36 with a shared button.

The bonus game is played in images appearing on the displays h1, h2, . . . hn of the respective stations s1, s2, s3, s4 . . . sn.

Image information of a bonus game is transmitted from the CPU 11 to the displays h1, h2, . . . hn of the respective stations s1, s2, s3, s4, . . . at which a bonus game is established, via the image circuit 525, whereby bonus game images are displayed.

Here, the image information of the bonus game corresponds to images showing spinning of the wheel rw2 and the ball rb2. After a predetermined period of time counted by the timer lapses, spinning actions of the wheel rw2 and the ball rb2 in the image are sequentially stopped.

Here, as in the case of a basic game, random numbers produced from the random number generator are used for random numbers to be used for determining the stop positions of the wheel rw2 and the ball rb2 in the bonus game.

Subsequently, occurrence of a win on the bonus game is determined for the respective stations s1, s2, s3, s4, . . . where the bonus game is played. Thus, bonus payout information; that is, the number of winning players or the number of credits to be paid out, is determined.

The determined bonus payout information is transmitted from the CPU 511 to the output circuit 527 of the stations s1, s2, s3, s4, . . . sn where the bonus games are played. Credits corresponding to a reward for achievement of a win are paid from the hoppers to winning players and stored in the payout receivers m1 . . . .

The bonus payout information is recorded on the RAM 513 or the hard disk drive 514 for respective stations s1, s2, s3, s4, . . . sn where bonus games is played.

When processing of the bonus game is completed, processing of a basic game is resumes.

Here, the game machine is constructed such that a bonus game is played in the form of an image by use of the displays h1, h2, . . . hn of the stations s1, s2, s3, s4 . . . where a bonus game is established. Needless to say, the bonus game can be performed by rotating actual wheel rw2 and the ball rb2.

Figure 16:
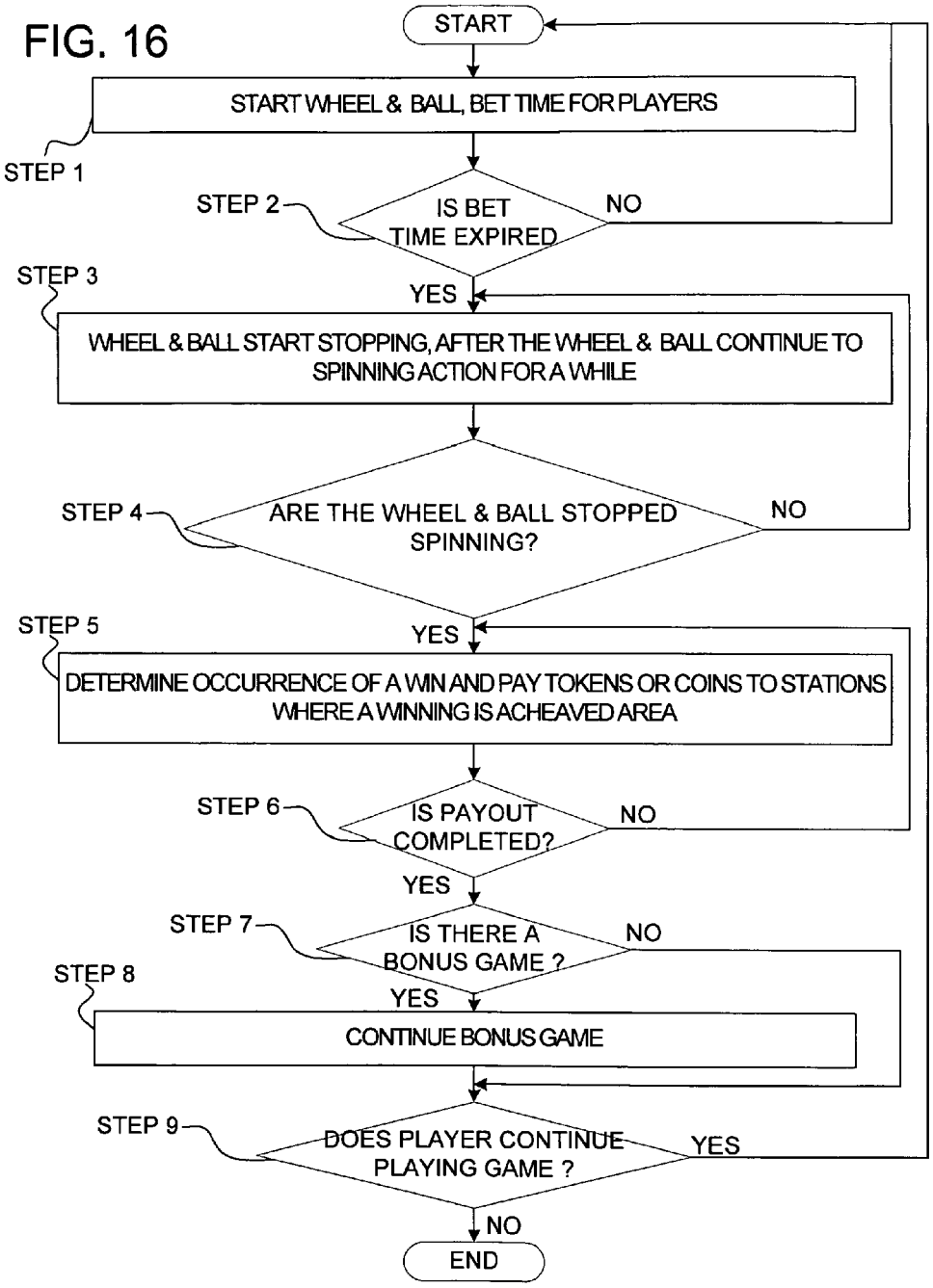
FIG. 16 illustrates a flow chart showing the flow of the wheel game to be played on a multi-station game machine of the embodiment.

Next, the flow of a series of operations pertaining to a game to be played on the multi-station game machine 500 will be described by reference to FIG. 16.

When a game machine manager presses a game start button (not shown) of the multi-station game machine 500 starts. (Step 1)

The wheel rw2 and the ball rb2 start spinning.

The wheel rw2 and the ball rb2 concurrently appear on the display panels h1, h2, . . . hn of the respective stations s1, s2, s3, s4, . . . sn. Further, a bet time information screen is displayed, thereby informing players of a bet time.

First, each of the players presses the touch panel button on the displays h1, h2, . . . hn to select desired bet area.

Subsequently, each of the players touch the bet button or the maximum bet button of the control button sections b1-*bn*, thereby setting and displaying a desired number of credits inserted by the player beforehand and still reserved, and bets on the selected bet area together with shared buttons sb1-sb8 when needed to specify shared bet areas.

(Step 2)

When the bet time finishes, the completion of the bet time is displayed on the displays h1, h2, . . . hn of the respective stations s1, s2, s3, s4, . . . sn, thus terminating the bet time information screen.

(Step 3)

After completion of the bet time, game sound effects are emitted from the speaker p1 in association with spinning of the wheel rw2 and the ball rb2. Further, sound images revolve around the game machine. Alternatively, the following control operation may be performed, as required. Namely, optical game effects are emitted from the game lamp u1, and illumination or blinking of light revolves the game machine.

After a predetermined period of time lapses from the end of the bet time, spinning of the wheel rw2 and the ball rb2 are sequentially stopped.

(Step 4)

The CPU 511 determines whether the wheel rw2 and the ball rb2 have stopped.

(Step 5)

Establishment of a win is determined for each of the stations s1, s2, s3, s4, . . . . Rewards are paid to the stations s1, s2, s3, s4, . . . where players have achieved a win. In other words, coins or tokens corresponding to a reward for the win are paid and stored in the payout receivers m1, m2 . . . mn.

(Step 6)

The CPU 511 determines whether payout processing has completed.

(Step 7)

The CPU 511 determines whether a result of establishment of a win for each of the stations s1, s2, s3, s4, . . . show any winners in the stations s1, s2, s3, s4 . . . Sn where a bonus game is established.

(Step 8)

When a bonus game is established in the stations s1, s2, s3, s4, . . . sn, a bonus game image appears on the display h1, h2 . . . hn of the stations s1, s2, s3, s4, . . . sn. where a bonus game is to be played.

Occurrence of a win is determined. A bonus payout; that is, credits corresponding to a reward for a bonus win, is paid from hoppers to winning players and stored in their payout receivers m1, m2 . . . mn. (Step 9)

When the players continue playing games, processing returns to (Step 1).

As mentioned above, the flow of a series of operations pertaining to a game to be played on the multi-station game machine 500 is described. As bonus games, which are to be displayed and played on the display h1 of the stations s1, s2, s3, s4, . . . sn, games other than the wheel game, such as card games or bingo games, may be employed.

Third Embodiment

In the above-mentioned embodiments, the primary game is performed in a center unit 510 and a secondary game or a bonus game is performed in the respective stations S1, S2, . . . Sn. As described above, the bonus game is triggered by the result of primary game.

This concept can be applied to a game management including a center unit 710 where a first primary game is preformed and a plurality of game stations (S1, S2, S3 and S4) where a second primary game and the bonus game triggered by the first primary game are performed. The center unit 710 and the game stations (S1, S2, S3 and S4) are connected through a network line as illustrated in FIG. 17

Figure 17:
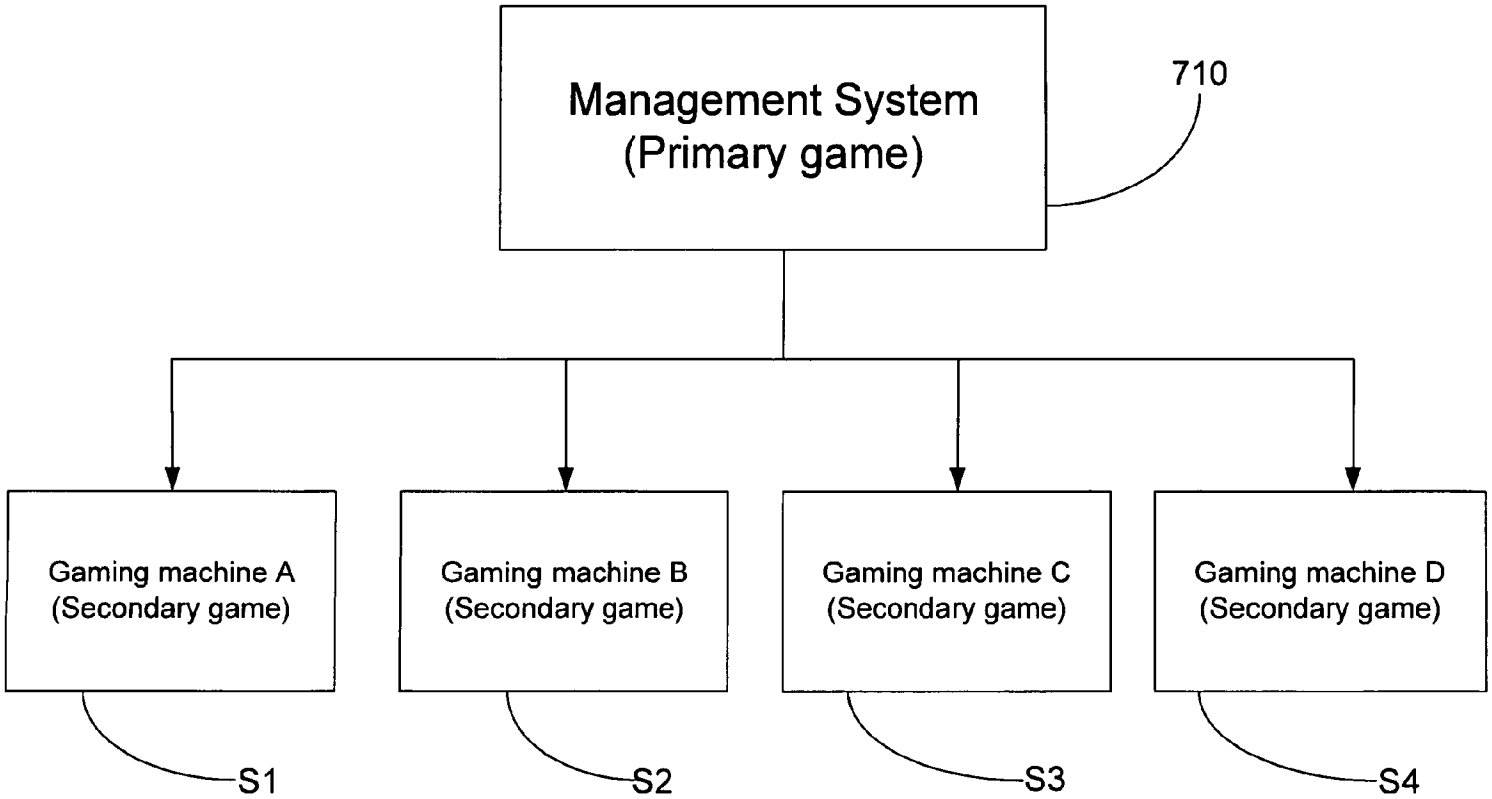
FIG. 17 illustrates another embodiment of the present invention, which is applied to a game management including a plurality of gaming machines.
Figure 18:
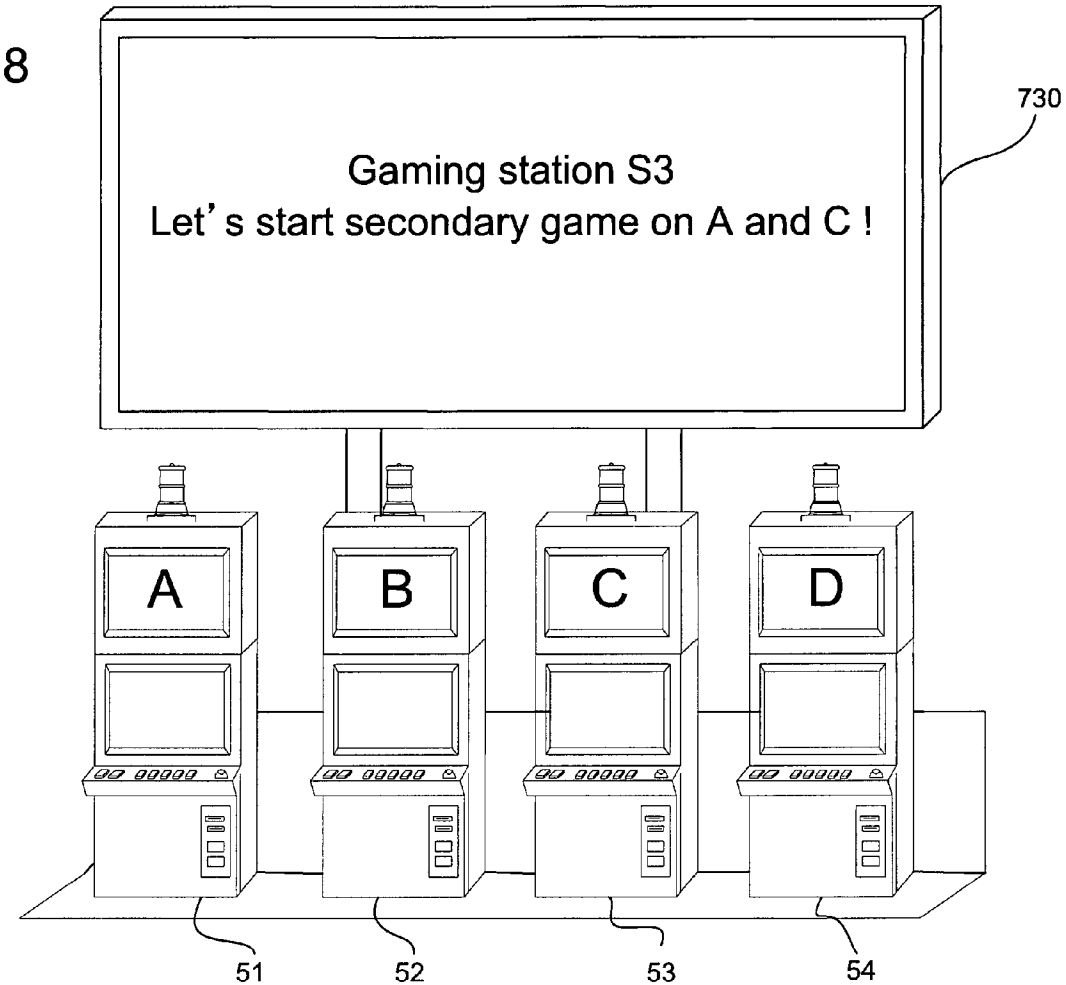
FIG. 18 illustrates a perspective view showing the game management system of FIG. 17 and an example of playing games on the plurality of game machines.

FIG. 18 illustrates a perspective view showing the game management system illustrated in FIG. 17 and an example of playing games on the plurality of game machines.

Games A, B, C and D are respectively performed on game stations S1-S4 as stand alone games performed on game stations illustrated in FIG. 18. The game station S1 is equipped with a card reader into which an ID card of a player can be inserted. In the ID card, ID (Identified Information) of the player, game history including the game stations on that the player has played in a past, a bet amount which the player has bet in a past, a reward amount that the player has obtained so far and an accumulated playing time.

The center unit 710 is arranged to perform a lottery operation for selecting a player playing with any one of the plurality of game machines networked to provide a bonus game. The lottery operation is performed at a predetermined time period based on the ID of the player to allow the player to play the bonus game on the same game machine with which the player is playing the second primary game.

For example, assuming that four players are playing games A, B, C and D respectively on the gaming stations S1-S4 by having inputted each ID information into respective game stations S1-S4.

All ID information is transmitted to the center unit 710 via the network 710. Then screening will be performed in the center unit 710 to check eligibility to join the lottery using data in the ID card.

The center unit 710 performs the lottery as a first primary game, for selecting a player to allow the player to perform the second game or a bonus game. And assuming that the player playing game on the game station S3, for example, has been selected as a result of the lottery.

Then, the notice is displayed on the display of the game stations S3 in order to notify the player that the player has been selected as a winner of the lottery performed by the center unit 710 and the bonus game has been provided to the player occupying the game station S3.

The notice may be displayed on external display 730 as illustrated in FIG. 18.

In case when the player plays and wins the bonus game, a bonus game reward, which was accumulated in the center unit 10, is paid to the player. In case when the player does not win the bonus game triggered by the lottery game, the reward amount, which is supposed to be paid to the player is held and the information of the reward amount will be accumulated and stored in the hard disc drive 714 for the next lottery reward so that the reward amount will increase and be carried over to the next bonus game when there is no winner on the bonus game performed on the game stations.

With respect to the predetermined time period, time period may be at any time period, for example, every four hours, once a day or once a week. Also, it is possible to set a certain criteria to join the lottery by using the information recorded on the ID card, for example, a loss exceeding a certain amount, or a bet amount exceeding a certain amount, which gives new excitement with gaming machines.

Figure 19:
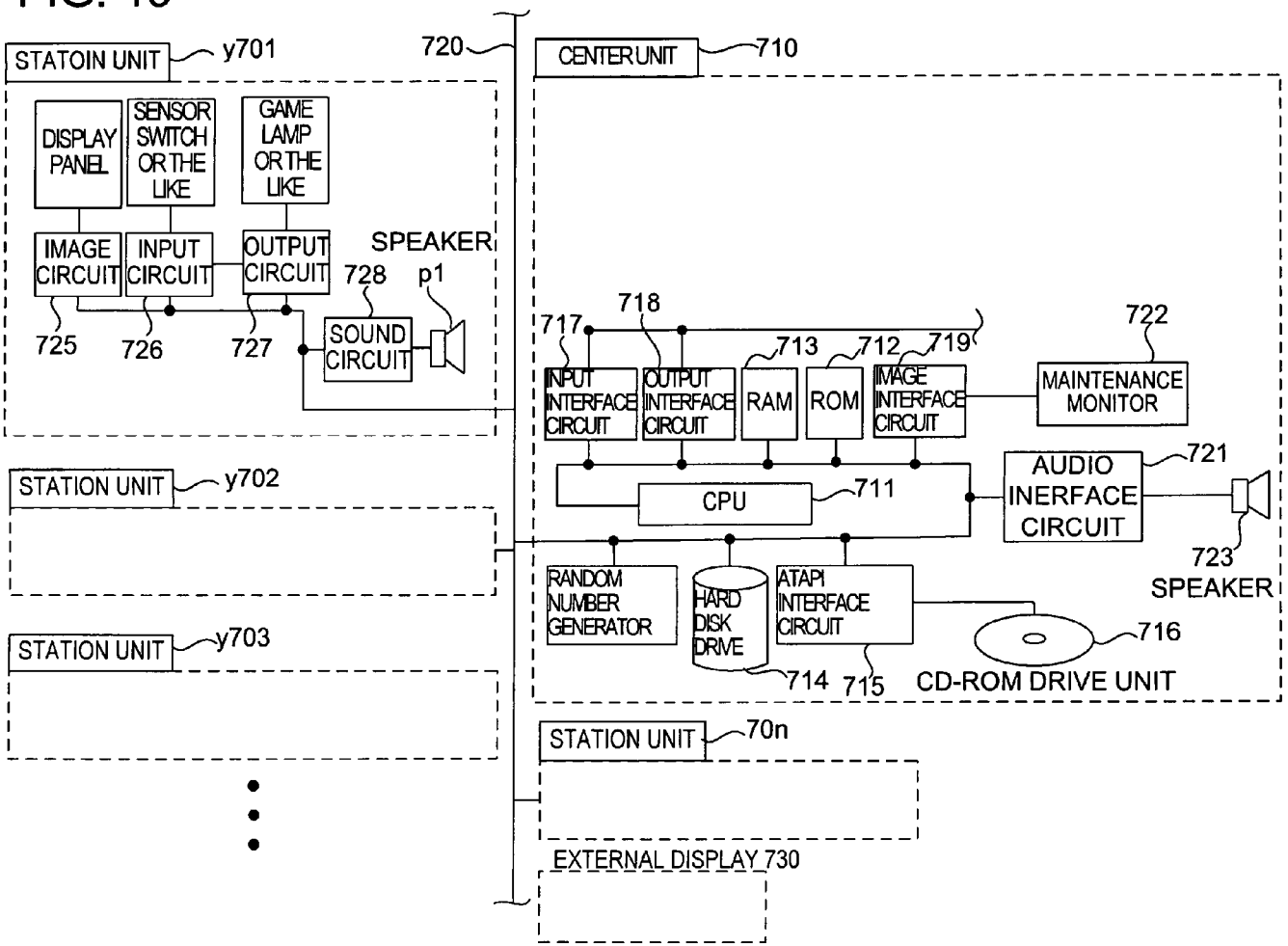
FIG. 19 illustrates a block diagram showing a control configuration of a center unit and a plurality of station unit, which are connected via network for a lottery game performed on the center unit for the bonus game on the plurality of station units.

FIG. 19 illustrates a block diagram showing a control configuration of a center unit and a plurality of station units, which are connected via network, for a lottery game performed on the center unit for the bonus game on the plurality of station units.

The block diagram shown in FIG. 19 is basically the same as block diagrams illustrated in FIGS. 1 and 15 except that the center unit 710 does not have reels 2, 3 and 4 as in FIG. 1, wheel rw2 and ball rb2 as in FIG. 15 but includes an external display 730. Accordingly, only the different points will be described here.

The center unit 710 is arranged to perform a lottery game to select players to be allowed to play bonus game on the station unit Y701, Y702, . . . Y70*n*, which are connected the center unit 710 with network 720, such as Ethernet.

Players, who want to play games on the station unit Y701, Y702, . . . Y70*n*, need to input their ID card into the card reader, which is connected to the input circuit 726. Once the ID card is read by the card reader, the contents of the ID card, for example, ID (Identified Information) of a player, game history including the game stations on that the player has played games in a past, a bet amount that the layer has betted in a past, a reward amount that the player obtained so far and accumulated playing time is transferred to the center unit 10 via the network 720 and is stored in the hard disk drive 714.

Accordingly, current player's information has been transferred to the center unit 710 and the information is arranged to be stored in hard disk drive 714 under the control of CPU 711.

When conducting the lottery operation on the central unit CPU 711, firstly a program stored in the hard disk drive 714 or ROM 712 screens player's information based on a certain criteria, for example, a loss has exceeded a certain amount, or a bet amount has exceeded a certain amount. Then, the program running on the CPU 711 performs lottery to select players to allow the players to have a chance to play bonus game on the station units where the players are playing games.

When players are selected by the lottery operation performed by the center unit 710, notices to those players selected by the lottery operation will be transmitted each stain unit via the network 720.

Then the notice will be displayed on display connected to image circuit 725. At the same time, this notice may be displayed on an external display 730, which is a relatively large display visible from people on the floor where these station units are placed. Since this will be performed by the central unit 710 without any prior notice to players playing on the game station, selected players are excited about being selected to have chance to play bonus games without any relation to the current game (the second primary game), and this gives new excitement to the gaming stations.

Then the current game performed by each station, which has received the notice, will be paused and a bonus game is started on the station.

In case when the player plays and wins the bonus game, the result is transmitted to the center unit 710 via the network 720. Then the bonus game reward, which was accumulated in the central unit 710, is divided and paid to the player. In case when the player does not win the bonus game triggered by the lottery game, the reward amount, which was supposed to be paid to the player is accumulated and stored in the hard disc drive 714 for the next lottery.

In either case, when the bonus game is completed the result is transmitted to the center unit 710 and the station unit resumes the original games, which were being performed before receiving the notice of the bonus game.

With respect to the bonus game, it may be a slot game, a bingo game and some other games.

The bonus game may be displayed on the external display 730 so that every body on the casino floor can pay attention to this event.

The present invention is not limited to the above embodiments and various changes and modification may be made without departing from the scope of the invention.

What is claimed is:

1. A multi-station game machine, comprising:

a display unit configured to display a game;

a plurality of gaming stations that are configured to accept player inputs, each station of the plurality of stations configured to allow each player to bet on the game via a bet area displayed on a display provided on each of the gaming stations and enable a first player to specify a bet area to be shared with a second player; and a controller coupled to the display unit and each gaming station of the plurality of gaming stations, the controller configured to:

receive a bet of a game value associated with the game from the first player at a first gaming station of the plurality of gaming stations;

allow the first player to select the second player at a second gaming station of the plurality of gaming stations to receive an award;

responsively generate an outcome associated with the game and display the game outcome on the display unit; and provide an award to the selected second player based on the generated game outcome, wherein the controller is configured such that when the first player bets on the shared bet area, the second player does not bet on the shared bet area, and a win is established on the shared bet area, the controller provides a first award to the first player as a reward for establishment of the win, and provides a second award to the second player as a result of the win established on the shared bet area.

2. A multi-station game machine in accordance with claim 1, wherein a bet associated with the game is received from the second player at the second gaming station, the controller is configured to provide a third award to the second player based on the game outcome and the bet received from the second player.

3. A multi-station game machine in accordance with claim 1, wherein the controller is further configured such that when the first and second players each bet a game value on the shared bet area, and a win is established on the shared bet area, the controller provides the first award as a reward for establishment of the win and the second award as a bonus payment to each of the first and second players.

4. A multi-station game machine, comprising:

a display unit configured to display a game including a plurality of reels including a plurality of symbols and a plurality of paylines extending across each reel of the plurality of reels;

a plurality of gaming stations that are configured to accept player inputs; and a controller coupled to the display unit and each gaming station of the plurality of gaming stations, the controller is configured to:

receive a bet of a game value associated with the game from a first player at a first gaming station of the plurality of gaming stations;

allow the first player to select at least a second player at a second gaming station of the plurality of gaming stations to receive an award;

allow each player to bet on one or more paylines of the plurality of paylines;

enable the first player to select at least one shared payline to be shared with the second player;

responsively generate an outcome associated with the game and display the game outcome on the display unit; and provide an award to the selected second player based on the generated game outcome.

5. A multi-station game machine in accordance with claim 4, wherein the controller is configured such that when the first player bets a game value on the shared payline and a winning outcome is established along the shared payline, the controller provides a first award to the first player and a second award to a second player.

6. A gaming system, comprising:

a plurality of gaming machines, each gaming machine including an input device for accepting bets of game value from a player and a display unit configured to display a game, each gaming machine of the plurality of gaming machines is configured to allow each player to bet on the game via a bet area displayed on the gaming machine display; and a controller coupled to each gaming machine of the plurality of gaming machines, the controller configured to:

receive a bet associated with the game from a first player at a first gaming machine of the plurality of gaming machines;

allow the first player to select at least a second player at a second gaming machine to receive an award;

enable the first player to specify a bet area to be shared with the second player for the game;

responsively generate an outcome associated with the game; and provide an award to the selected second player based on the generated game outcome wherein the controller is further configured such that when the first player bets on the shared bet area, the second player does not bet on the shared bet area, and a win is established on the shared bet area, the controller provides a first award to the first player as a reward for establishment of the win, and provides a second award to the second player for the win established on the shared bet area.

7. A gaming system in accordance with claim 6, wherein a bet associated with the game is received from the selected second player at the second gaming machine, the controller is configured to provide a third award to the second player based on the game outcome and the bet received from the second player.

8. A gaming system in accordance with claim 6, wherein the controller is further configured such that when the first and second players each bet on the shared bet area, and the win is established on the shared bet area, the controller provides the first award as a reward for establishment of the win and the second award as a bonus payment to each of the first and second players for the establishment of the win on the shared bet area.

9. A gaming system, comprising:

a plurality of gaming machines, each gaming machine including an input device for accepting bets of game value from a player and a display unit configured to display a game, each gaming machine is configured to display the game including a plurality of reels including a plurality of symbols and a plurality of paylines extending across each reel of the plurality of reels; and a controller coupled to each gaming machine of the plurality of gaming machines, the controller configured to:

receive a bet associated with the game from a first player at a first gaming machine of the plurality of gaming machines;

allow the first player to select at least a second player at a second gaming machine to receive an award;

allow each player to bet on one or more paylines of the plurality of paylines;

enable the first player to select at least one shared payline to be shared with the second player;

responsively generate an outcome associated with the game; and provide an award to the selected second player based on the generated game outcome.

10. A gaming system in accordance with claim 9, wherein the controller is further configured such that when the first player bets on the shared payline, the second player does not bet on the shared payline, and a win is established along the shared payline, the controller provides a first award to the first player as a reward for establishment of the win, and provides a second award to the second player for the win established on the shared payline.

11. A gaming system in accordance with claim 10, wherein the controller is further configured such that when the first and second players each bet on the shared payline, and the win is established on the shared payline, the controller provides the first award as a reward for establishment of the win and the second award as a bonus payment to each of the first and second players for the establishment of the win on the shared payline.

12. A method of allowing a plurality of players to play a game on a gaming system that includes a plurality of gaming machines, each gaming machine of the plurality of gaming machines including a display that is configured to allow each player to bet on the game via a bet area displayed on the gaming machine display, comprising the steps of:

allowing a first player to make a bet of game value on the game at a first gaming machine;

allowing the first player to select at least a second player at a second gaming machine to receive an award;

allowing the first player to select a bet area to be shared with the second player for the game randomly generating an outcome of the game and displaying the outcome on a display unit; and providing an award to the selected second player based on the generated game outcome; and determining if the first player bet a game value on the shared bet area and the second player did not bet any game value on the shared bet area and responsively providing a first award to the first player as a reward for establishment of the win and a second award to the second player as a celebratory reward for the establishment of the win on the shared bet area.

13. A method in accordance with claim 12, further comprising the steps of:

allowing the second player to make a bet on the game at the second gaming machine; and providing a third award to the second player based on the game outcome and the bet received from the second player.

14. A method of allowing a plurality of players to play a game on a gaming system that includes a plurality of gaming machines, each gaming machine of the plurality of gaming machines includes a display that is configured to display the game including a plurality of reels including a plurality of symbols and a plurality of paylines extending across each reel of the plurality of reels and to allow each player to bet on one or more of the paylines, comprising the steps of:

allowing a first player to make a bet of game value on the game at a first gaming machine;

allowing the first player to select at least a second player at a second gaming machine to receive an award;

allowing the first player to select at least one shared payline to be shared with the second player;

randomly generating an outcome of the game and displaying the outcome on a display unit;

providing an award to the selected second player based on the generated game outcome;

providing a first award to the first player as a reward for establishment of a win along the selected shared payline; and providing a second award to the second player for the win established on the shared payline.

15. A method in accordance with claim 14, including the steps of determining if the first player bets a game value on the shared payline and a winning outcome is established along the shared payline, and responsively providing the first award to the first player and the second award to a second player.

16. A method in accordance with claim 14, including the steps of determining if the first player bets on the shared payline, the second player does not bet on the shared payline, and a win is established along the shared payline; and responsively providing the first award to the first player as a reward for establishment of the win and providing the second award to the second player for the win established on the shared payline.

17. A method in accordance with claim 16, including the steps of determining if the first and second players each bet on the shared payline and the win is established on the shared payline; and responsively providing the first award as a reward for establishment of the win and the second award as a bonus payment to each of the first and second players for the establishment of the win on the shared payline.

18. A multi-station game machine in accordance with claim 4, wherein the controller is further configured such that when the first player bets on the shared payline, the second player does not bet on the shared payline, and a win is established along the shared payline, the controller provides a first award to the first player as a reward for establishment of the win, and provides a second award to the second player for the win established on the shared payline.

19. A multi-station game machine in accordance with claim 18, wherein the controller is further configured such that when the first and second players each bet on the shared payline, and the win is established on the shared payline, the controller provides the first award as a reward for establishment of the win and the second award as a bonus payment to each of the first and second players for the establishment of the win on the shared payline.

20. A method in accordance with claim 12, including the steps of:

determining if the first and second players each bet on the shared bet area and the win is established on the shared bet area; and providing the first award as a reward for establishment of the win and the second award as a bonus payment to each of the first and second players for the establishment of the win on the shared bet area.

* * * * *